US009824653B2

(12) United States Patent
Park et al.

(10) Patent No.: US 9,824,653 B2
(45) Date of Patent: Nov. 21, 2017

(54) LIQUID CRYSTAL DISPLAY AND METHOD FOR DRIVING THE SAME

(71) Applicant: Samsung Display Co., Ltd., Yongin (KR)

(72) Inventors: Su-Hyeong Park, Yongin (KR); Ji-Myoung Seo, Yongin (KR); Ho-Yong Jung, Yongin (KR); Eun-Ho Lee, Yongin (KR); Cheol-Woo Park, Yongin (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 416 days.

(21) Appl. No.: 14/533,855

(22) Filed: Nov. 5, 2014

(65) Prior Publication Data

US 2015/0194110 A1 Jul. 9, 2015

(30) Foreign Application Priority Data

Jan. 8, 2014 (KR) ..... 10-2014-0002148

(51) Int. Cl.
*G09G 5/10* (2006.01)
*G09G 3/36* (2006.01)

(52) U.S. Cl.
CPC ..... *G09G 3/3614* (2013.01); *G09G 3/3648* (2013.01); *G09G 3/3677* (2013.01); *G09G 3/3607* (2013.01); *G09G 3/3688* (2013.01); *G09G 2310/0224* (2013.01); *G09G 2310/0264* (2013.01); *G09G 2310/0286* (2013.01); *G09G 2310/08* (2013.01)

(58) Field of Classification Search
CPC ..... G09G 3/3614; G09G 3/3677; G11C 19/28
USPC ..... 345/96, 99, 690; 377/67
See application file for complete search history.

(56) References Cited

U.S. PATENT DOCUMENTS

| | | | | |
|---|---|---|---|---|
| 6,239,779 | B1 | 5/2001 | Furuya et al. | |
| 7,522,145 | B2 | 4/2009 | Lee | |
| 7,808,494 | B2 | 10/2010 | Lee et al. | |
| 8,274,460 | B2 | 9/2012 | Moon | |
| 9,129,576 | B2 * | 9/2015 | Chen | G09G 3/3677 |
| 2002/0122349 | A1 | 9/2002 | Kobayashi | |
| 2008/0055282 | A1 * | 3/2008 | Lee | G09G 3/20 345/204 |
| 2008/0218500 | A1 | 9/2008 | Akai et al. | |

(Continued)

FOREIGN PATENT DOCUMENTS

| | | |
|---|---|---|
| JP | 07199154 | 8/1995 |
| KR | 1020080026392 | 3/2008 |
| KR | 1020080049464 | 6/2008 |

*Primary Examiner* — Calvin C Ma
(74) *Attorney, Agent, or Firm* — Cantor Colburn LLP

(57) ABSTRACT

A liquid crystal display includes: a display panel including data lines, scan lines and a plurality of pixels connected to the data lines and the scan lines; a scan driver configured to supply scan signals to the scan lines; a data driver configured to supply data voltages to the data lines; and a timing controller configured to control operation timings of the scan driver and the data driver, where the timing controller is configured to output a plurality of scan output enable signals to the scan driver, and the scan driver is configured to supply odd scan signals to odd scan lines based on a first scan output enable signal of the scan output enable signals and to supply even scan signals to even scan lines based on a second scan output enable signal of the scan output enable signals.

20 Claims, 18 Drawing Sheets

(56) References Cited

U.S. PATENT DOCUMENTS

| | | | | |
|---|---|---|---|---|
| 2008/0224980 | A1 | 9/2008 | Senda et al. | |
| 2011/0002438 | A1* | 1/2011 | Kim | G11C 19/28 377/67 |
| 2013/0328855 | A1* | 12/2013 | Li | G09G 3/3696 345/212 |

* cited by examiner

LIQUID CRYSTAL DISPLAY AND METHOD FOR DRIVING THE SAME

This application claims priority to Korean Patent Application No. 10-2014-0002148, filed on Jan. 8, 2014, and all the benefits accruing therefrom under 35 U.S.C. §119, the content of which in its entirety is herein incorporated by reference.

BACKGROUND

1. Field

Exemplary embodiments of the invention relate to a liquid crystal display and a method for driving the liquid crystal display.

2. Description of the Related Art

A range of application for liquid crystal displays has gradually widened because of characteristics thereof, such as light weight, thin profile and low power consumption, for example. The liquid crystal displays have been widely used in personal computers such as a laptop computer, an office automation equipment, an audio/video equipment, an interior/outdoor advertising display device, and the like, for example.

In general, the liquid crystal display controls an electric field applied to a liquid crystal layer and modulates light from a backlight unit, thereby displaying an image. The liquid crystal display includes pixels, a scan driver and a data driver. Pixels are arranged substantially in matrix form and connected to data lines and scan lines, which cross each other. The scan driver supplies scan signals to the scan lines. The data driver supplies data voltages to the data lines. Each pixel includes a pixel electrode, a storage capacitor, and the like. Each pixel is connected or coupled to a scan line and a data line through a transistor. The transistor is turned on in response to a scan signal of the scan line, such that a data voltage of the data line is supplied to the pixel electrode through the turned-on transistor. Each pixel modulates light from the backlight unit by an electric field generated between the pixel electrode, which the data voltage is supplied to, and a common electrode, which a common voltage is supplied to.

Generally, the scan driver is driven as sequential addressing mode which sequentially supplies the scan signals to the scan lines. Also, the data driver alternately supplies a positive data voltage and a negative data voltage every predetermined period to prevent flicker and direct current image sticking. The data driver supplies the data voltages as a frame inversion method since power consumption of the liquid crystal display is higher if an inversion cycle of the data voltages is shorter. The frame inversion method represents a method which inverts polarities of the data voltages every predetermined frame period.

SUMMARY

FIG. 1 is a diagram illustrating an exemplary horizontal stripe pattern. Referring to FIG. 1, the horizontal stripe pattern refers to a pattern in which peak white gray level is displayed on odd lines (or even lines) and peak black gray level is displayed on even lines (or odd lines). The data driver alternately supplies a peak white gray level voltage and a peak black gray level voltage every horizontal period to display the horizontal stripe pattern. Therefore, when the liquid crystal display displays the horizontal stripe pattern, power consumption of the liquid crystal display is high even though the data driver supplies the data voltages as the frame inversion method when the horizontal stripe pattern is displayed. The horizontal stripe pattern is shown in FIG. 1 as one of patterns which increase power consumption of the liquid crystal display for convenience of description. Also, it is difficult to change an order of supplying the data voltages to pixels if the scan driver is driven as the sequential addressing mode. Therefore, it is difficult to decrease power consumption of the liquid crystal display in the sequential addressing mode.

Exemplary embodiments of the invention relate to a liquid crystal display and method for driving the liquid crystal display, which may decrease power consumption.

According to an exemplary embodiment of embodiments of the invention, a liquid crystal display includes: a display panel including data lines, scan lines and a plurality of pixels connected to the data lines and the scan lines; a scan driver configured to supply scan signals to the scan lines; a data driver configured to supply data voltages to the data lines; and a timing controller configured to control operation timings of the scan driver and the data driver, where the timing controller is configured to output a plurality of scan output enable signals to the scan driver, and the scan driver is configured to supply odd scan signals to odd scan lines based on a first scan output enable signal of the scan output enable signals and to supply even scan signals to even scan lines based on a second scan output enable signal of the scan output enable signals.

According to another exemplary embodiment of the invention, a method for driving a liquid crystal display includes: A method for driving a liquid crystal display includes: outputting a plurality of scan output enable signals from a timing controller of the liquid crystal display to a scan driver of the liquid crystal display, where the timing controller controls the scan driver and a data driver of the liquid crystal display; supplying scan signals from the scan driver to scan lines of a display panel of the liquid crystal display; and supplying data voltages from the data driver to data lines of the display panel of the liquid crystal display, where the supplying the scan signals from the scan driver to the scan lines includes: supplying the scan signals from the scan driver to odd scan lines based on a first scan output enable signal of the scan output enable signals; and supplying the scan signals from the scan driver to even scan lines based on a second scan output enable signal of the scan output enable signals.

According to an exemplary embodiment of embodiments of the invention, a liquid crystal display includes: a display panel including data lines, scan lines and a plurality of pixels connected to the data lines and the scan lines; a scan driver configured to supply scan signals to the scan lines; a data driver configured to supply data voltages to the data lines; and a timing controller configured to control operation timings of the scan driver and the data driver, where the timing controller is configured to output a scan output enable signal and a plurality of address signals, and the scan driver is configured to output the scan signals to the scan lines based on the scan output enable signal and the address signals.

According to another exemplary embodiment of the invention, a method for driving a liquid crystal display includes: outputting a scan output enable signal and a plurality of address signals from a timing controller of the liquid crystal display to a scan driver of the liquid crystal display, where the timing controller controls the scan driver and a data driver of the liquid crystal display; supplying scan signals from the scan driver to scan lines of a display panel of the liquid crystal display; and supplying data voltages from the data driver to data lines of the display panel of the liquid crystal display, where the supplying the scan signals from the scan driver to the scan lines includes supplying the scan signals from the gate driver to the scan lines based on the scan output enable signal and the address signals.

BRIEF DESCRIPTION OF THE DRAWINGS

The above and other features of the invention will become more apparent by describing in detail exemplary embodiments thereof with reference to the attached drawings, in which.

DETAILED DESCRIPTION

Figure 1:
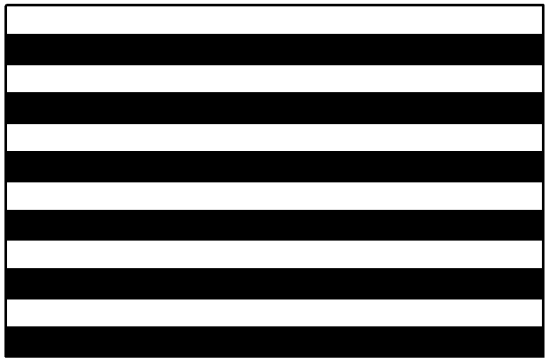
FIG. 1 (PRIOR ART)
FIG. 1 is an exemplary diagram illustrating an exemplary horizontal stripe pattern displayed on a liquid crystal display.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Figure 2:
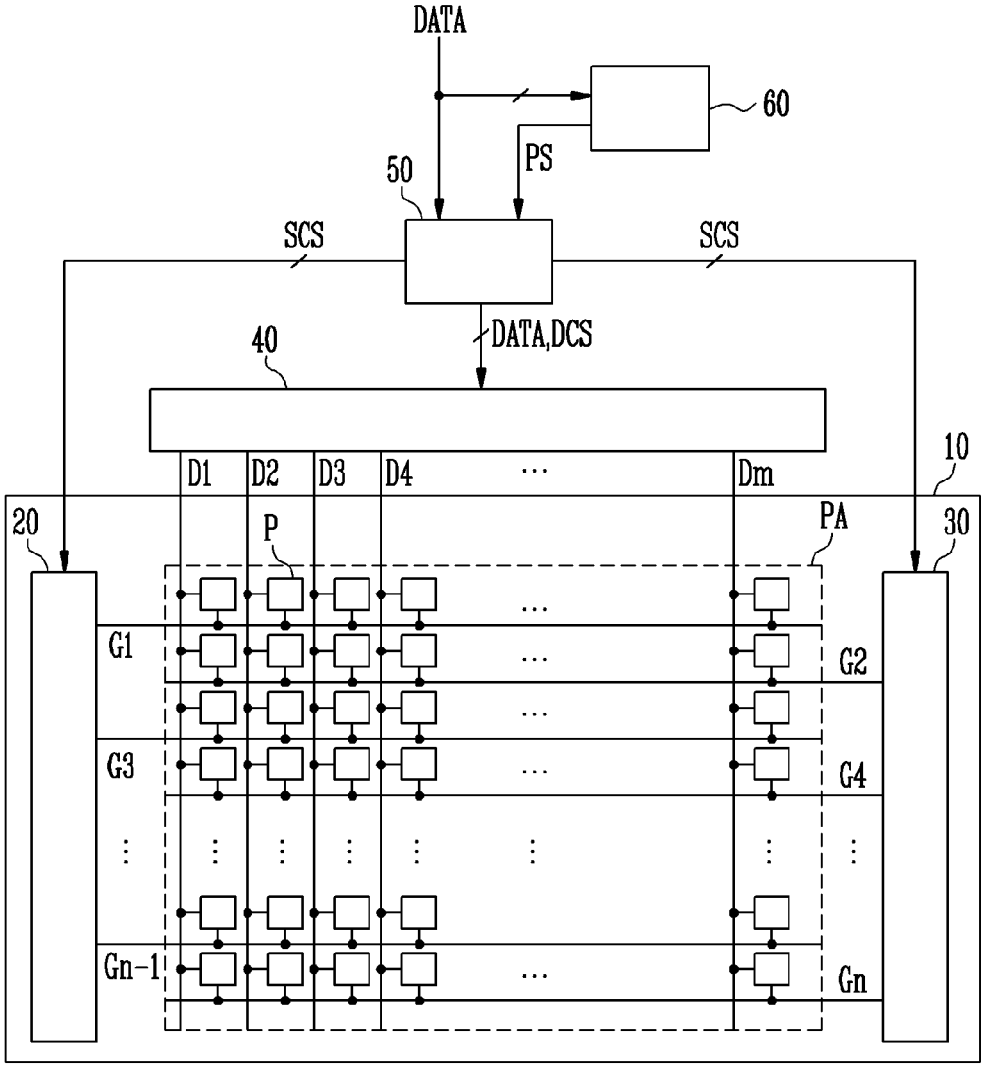
FIG. 2 is a block diagram showing an exemplary embodiment of a liquid crystal display according to the invention.

FIG. 2 is a block diagram showing an exemplary embodiment of a liquid crystal display according to the invention. Referring to FIG. 2, the liquid crystal display includes a liquid crystal display panel 10 including a pixel array PA disposed therein, a scan driver, a data driver 40, a timing controller 50, an image pattern calculator 60, and the like.

The liquid crystal display panel includes an upper substrate, a lower substrate and a liquid crystal layer disposed between the upper substrate and the lower substrate. The pixel array PA is disposed on the lower substrate of the liquid crystal display panel 10. Pixels P, data lines D1 to Dm (here, m is a positive integer of 2 or greater), scan lines G1 to Gn (n is a positive integer of 8 or greater) are disposed in the pixel array PA. The pixels P are disposed substantially in a matrix form. In one exemplary embodiment, for example, the pixels may be disposed in cell areas defined by the data lines D1 to Dm and scan lines G1 to Gn. The data lines D1 to Dm and the scan lines G1 to Gn are disposed to cross each other.

Each pixel P includes a thin film transistor, a pixel electrode, a common electrode, a storage capacitor. Each pixel P controls the transmission of light passing therethrough by driving liquid crystals of the liquid crystal layer using an electric field generated between a data voltage supplied to the pixel electrode and a common voltage supplied to a common electrode. The thin film transistor supplies the data voltage from a data line to the pixel electrode in response to a scan signal of a scan line. The storage capacitor maintains the data voltage supplied to the pixel electrode for a predetermined period.

A black matrix, color filters and the like may be disposed on an upper substrate of the liquid crystal display panel 10. The common electrode may be disposed on the upper substrate when the liquid crystal display panel 10 is in a vertical electric field driving mode, such as a twisted nematic ("TN") mode or a vertical alignment ("VA") mode. The common electrode may be disposed on the lower substrate when the liquid crystal display panel 10 is in a horizontal electric field driving method, such as an in-plane switching ("IPS") mode or a fringe field switching ("FFS") mode. The liquid crystal mode of the liquid crystal display panel 10 may be implemented as any liquid crystal mode, as well as the TN mode, the VA mode, the IPS mode and the FFS mode, described above.

An upper polarizing plate is disposed on, e.g., attached to, the upper substrate, and a lower polarizing plate is disposed on, e.g., attached to, the lower substrate. The light transmission axes of the upper and lower polarizing plates may be disposed substantially perpendicular to each other. In addition, alignment layers for setting a pre-tilt angle of liquid crystals may be disposed on the upper and lower substrates, respectively. A spacer for maintaining a cell gap of the liquid crystal layer may be disposed between the upper and lower substrates.

The backlight unit may be disposed under the liquid crystal display panel 10. The backlight unit emits light to the liquid crystal display panel 10. The backlight unit may be implemented as a direct-type or edge-type backlight unit.

The data driver 40 includes a plurality of source drive integrated circuits ("IC" s). The source drive ICs may be disposed, e.g., mounted, on a source tape carrier package ("TCP"). The source TCP may be connected or bonded to the liquid crystal display panel 10 and a source printed circuit board ("PCB") by a tape automated bonding ("TAB") process. Alternatively, the source drive ICs may be directly disposed or bonded on the lower substrate of the liquid crystal display panel 10 by a chip on glass ("COG") process.

The source drive ICs receive digital video data DATA from the timing controller 40. The source drive ICs convert the digital video data DATA into positive/negative data voltages in response to a source timing control signal DCS from the timing controller 40. The source drive ICs supply the data voltages to the data lines D1 to Dm of the liquid crystal display panel 10 in synchronization with scan signals. Therefore, the data voltages are supplied to pixels to which a scan signal is supplied.

The scan driver includes a plurality of scan drive circuits 20, 30. A first scan drive circuit 20 of the scan drive circuits may be disposed to the outside of one side of the pixel array PA, and a second scan drive circuit 30 of the scan drive circuits may be disposed to the outside other side of the pixel array PA. Each of the first and second scan drive circuits 20, 30 may be disposed on a scan TCP. The scan TCP may be connected or bonded to the liquid crystal display panel 10 by the tape automated bonding process. Alternatively, each of the first and second scan drive circuits 20, 30 may be directly provided or formed on the lower substrate by a gate in panel ("GIP") process.

The first and second scan drive circuits 20, 30 receive a scan timing control signal SCS from the timing controller 50. The first scan drive circuit 20 supplies scan signals to odd scan lines G1, G3, . . . , Gn−1 in response to the scan timing control signal SCS. The second scan drive circuit 30 supplies scan signals to even scan lines G2, G4, . . . , Gn in response to the scan timing control signal SCS.

The timing controller 50 may be disposed, e.g., mounted, on a control PCB. The control PCB may be connected to the source PCB through a flexible circuit board, such as a flexible flat cable ("FFC"), a flexible printed circuit ("FPC").

The timing controller 50 receives the digital video data DATA and timing signals from an external system board (not shown). The timing signals include a vertical synchronization signal, a horizontal synchronization signal, a data enable signal and a dot clock, for example. The timing controller 50 generates the scan timing control signal SCS for controlling operation timings of the scan drive circuits 20, 30, and the data timing control signal DCS for controlling operation timing of the data driver 40. The timing controller supplies the digital video data DATA and the data timing control signal DCS to the data driver 40. The timing controller supplies the scan timing control signal SCS to the scan drive circuits 20, 30.

The scan timing control signal SCS may include a scan start signal, a scan clock signal, and scan output enable signals. The scan start signal controls an output timing of a first scan signal. The scan clock signal shifts the scan start signal. The scan output enable signals control output timings of the scan signals.

The data timing control signal DCS may include a source start pulse, a source sampling clock, a polarity control signal, a source output enable signal, and the like, for example. The source start pulse controls a data sampling start time point of the data driver 40. The source sampling clock controls a sampling operation of the data driver 40 based on a rising or falling edge thereof. In an exemplary embodiment, where the digital video data DATA is transmitted from the timing controller 50 to the data driver 40 based on a mini low voltage differential signaling ("LVDS") interface standard, the source start pulse and the source sampling clock may be omitted. The polarity control signal inverts polarities of the data voltages output from the data driver 40 every L horizontal periods, where L is a positive integer. The source output enable signal controls output timings of the data voltages.

The timing controller 50 controls operation timings of the first and second scan drive circuits 20, 30 and the data driver 40 based on one of a sequential addressing ("SA") mode and a transition minimized addressing ("TMA") mode. In the SA mode, the first and second scan drive circuits 20, 30 sequentially supply the scan signals to the scan lines. In the TMA mode, the first and second scan drive circuits 20, 30 supply the scan signals to the scan lines in a predetermined order for minimizing a swing cycle of the data voltages from the data driver 40 to the data lines D1 to Dm. The power consumption in the TMA mode may be lower than the power consumption in the SA mode by minimizing a swing cycle of the data voltages when a predetermined image pattern is displayed in the liquid crystal display panel 10. The timing controller 50 controls the operation timings of the scan drive circuits 20, 30 and the data driver 40 based on the SA mode or the TMA mode based on an image pattern signal PS from the image pattern calculator 60.

The image pattern calculator 60 receives the digital video data DATA from the external system board (not shown). The image pattern calculator 60 analyzes the digital video data DATA and calculates an image pattern of the digital video data DATA. In such an embodiment, the image pattern calculator 60 determines whether the calculated image pattern is substantially the same as a predetermined image pattern. The image pattern calculator 60 outputs the image pattern signal PS having a first logic level to the timing controller 50 when the calculated image pattern is substantially the same as the predetermined image pattern. The image pattern calculator 60 outputs the image pattern signal PS having a second logic level to the timing controller 50 when the calculated image pattern is not substantially the same as the predetermined image pattern.

The timing controller 50 controls the operation timings of the first and second scan drive circuits 20, 30 and the data driver 40 based on the TMA mode when the image pattern signal PS having the first logic level is input to the timing controller 50. The timing controller 50 controls the operation timings of the first and second scan drive circuits 20, 30 and the data driver 40 based on the SA mode when the image pattern signal PS having the second logic level is input to the timing controller 50. The timing controller 50 switches the driving mode of the first and second scan drive circuits 20, 30 and the data driver 40 from the SA mode to the TMA mode by controlling the scan timing control signal SCS and the data timing control signal DCS.

As described above, in an exemplary embodiment, the liquid crystal display controls the operation timings of the scan drive circuits 20, 30 and the data driver 40 based on the SA mode or the TMA mode based on the image pattern calculated from the digital video data DATA. The SA mode and the TMA mode will be described later in detail in FIGS. 5 to 8 and 10 to 12.

Figure 3:
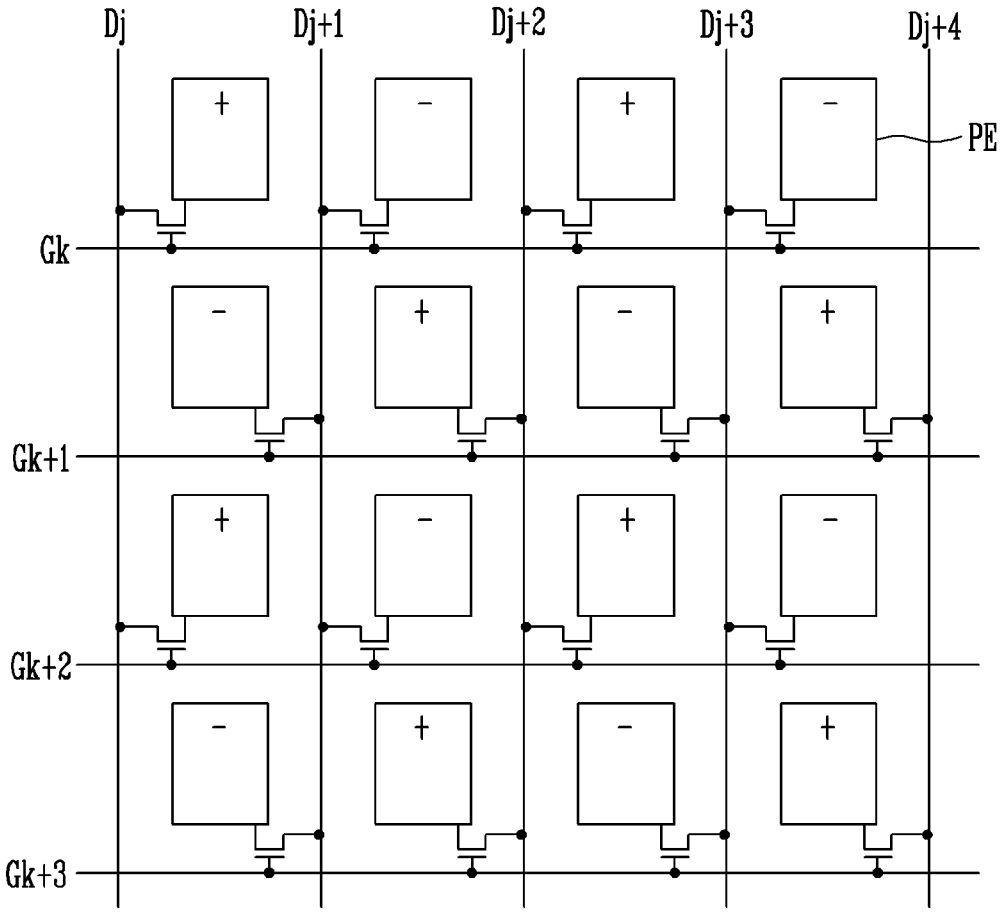
FIG. 3 is an exemplary diagram illustrating pixels on an exemplary embodiment of a pixel array of FIG. 2.

FIG. 3 is a diagram illustrating pixels on an exemplary embodiment of a pixel array of FIG. 2. In FIG. 3, j-th to (j+4)-th data lines Dj to Dj+4 (j is a positive integer less than m), k-th to (k+3)-th scan lines Gk to Gk+3 (k is a positive integer less than n), and pixel electrodes PE connected to the j-th to (j+4)-th data lines Dj to Dj+4 and the k-th to (k+3)-th scan lines Gk to Gk+3 are illustrated. A pixel electrode PE may be coupled to a scan line and a data line through a thin film transistor.

Referring to FIG. 3, a data line is coupled (e.g., connected) to the pixel electrodes PE sequentially in a zigzag pattern in a vertical direction (y-axis direction). In one exemplary embodiment, for example, the (j+1)-th data line Dj+1 is coupled to a pixel electrode PE coupled to the k-th scan line Gk and arranged in one side of the (j+1)-th data line Dj+1. Also, the (j+1)-th data line Dj+1 is coupled to a pixel electrode PE coupled to the (k+1)-th scan line Gk+1 and arranged in the other side of the (j+1)-th data line Dj+1. Also, the (j+1)-th data line Dj+1 is coupled to a pixel electrode PE coupled to the (k+2)-th scan line Gk+2 and arranged in the one side of the (j+1)-th data line Dj+1. Also, the (j+1)-th data line Dj+1 is coupled to a pixel electrode PE coupled to the (k+3)-th scan line Gk+3 and arranged in the other side of the (j+1)-th data line Dj+1. In such an embodiment, as shown in FIG. 3, the one side may be a left side, and the other side may be a right side.

When data voltages having a negative polarity (−) are supplied to the (j+1)-th data line Dj+1 and data voltages having a positive polarity (+) are supplied to the (j+2)-th data line Dj+2, polarities of data voltages supplied to pixel electrodes PE coupled to the (j+1)-th data line Dj+1 are opposite to polarities of data voltages supplied to pixel electrodes PE coupled to the (j+2)-th data line Dj+2. Therefore, the pixels are driven as a dot inversion method even though the data driver 40 supplies the data voltages to the data lines D1 to Dm in a column inversion method. The dot inversion method refers to a method of supplying the data voltages to the pixel electrodes so that a polarity of a data voltage supplied to a pixel electrode is opposite to a polarity of data voltages supplied to pixel electrodes adjacent to the pixel electrode. The column inversion method refers to a method of supplying data voltage to the data lines so that a polarity of a data voltage supplied to a data line is opposite to a polarity of data voltages supplied to data lines adjacent to the data line. In such an embodiment, the power consumption may be reduced by supplying data voltages to the data lines D1 to Dm in the column inversion method, and an image sticking and flicker may be effectively prevented by driving the pixels under the dot inversion method.

Figure 4A:
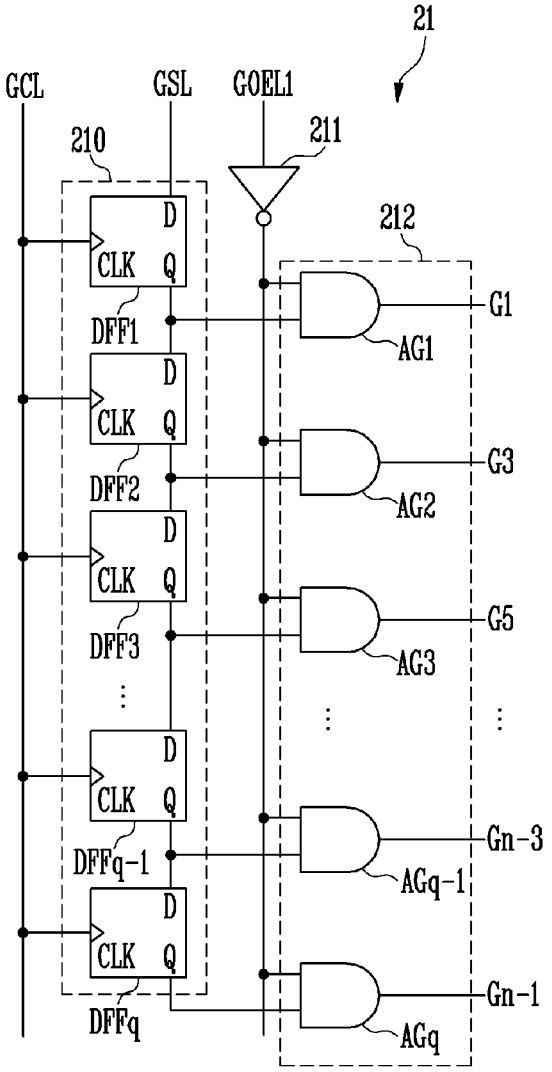
FIGS. 4A and 4B are block diagrams showing exemplary embodiments of first and second scan drive circuits of FIG. 2.

FIG. 4A is a block diagram showing an exemplary embodiment of the first scan drive circuit of FIG. 2. In an exemplary embodiment, as shown in FIG. 4A, the first scan drive circuit 20 includes a first shift register 21, a first level shifter, a first output buffer, and the like. The first shift register 21 sequentially shifts a scan start signal GST (shown in FIG. 5) based on a scan clock signal GCLK (shown in FIG. 5), and outputs odd scan signals according to a first scan output enable signal GOE1 (shown in FIG. 5). The first level shifter converts a swing width of each of the odd scan signals to a swing width suitable for driving thin film transistors of the liquid crystal display panel 10. In FIG. 4A, only the first shift register 21 is illustrated for convenience of description.

Referring to FIG. 4A, the first shift register 21 includes a first D flip-flop circuit 210, a first inverter 211 and a first AND gate group 212. The first D flip-flop circuit 210 includes first to q-th D flip-flops DFF1 to DFFq (q is a positive integer satisfying the following inequation: $2q \leq n$), which are connected to each other in a cascade manner. The first AND gate group 212 includes first to q-th AND gates AG1 to AGq.

An input terminal D of a D flip-flop of the first D flip-flop circuit 210 is coupled to a scan start signal line GSL to which a scan start signal is supplied or an output terminal Q of a front D flip-flop. A clock terminal CLK of the D flip-flop of the first D flip-flop circuit 210 is coupled to a scan clock signal line GCL to which a scan clock signal is supplied. An output terminal Q of the D flip-flop of the first D flip-flop circuit 210 is coupled to an input terminal of a rear D flip-flop. A front D flip-flop of a p-th D flip-flop DFFp (p is a positive integer satisfying the following inequation: $1 \leq p \leq q$) refers to one of first to (p−1)-th D flip-flops DFF1 to DFFp−1. A rear D flip-flop of the p-th D flip-flop DFFp refers to one of (p+1)-th to q-th D flip-flops DFFp+1 to DFFq. Also, an output terminal Q of the p-th D flip-flop DFFp of the first D flip-flop circuit 210 is coupled to a p-th AND gate AGp. In such an embodiment, as shown in FIG. 4A, an output terminal Q of the first flip-flop DFF1 of the first D flip-flop circuit 210 is coupled to a first AND gate AG1 of the first AND gate group 212.

The first inverter 211 supplies an inversion signal of the first scan output enable signal received through the first scan output enable signal line GOEL1 to the first AND gate group 212. The p-th AND gate AGp of the first AND gate group 212 outputs a result of AND operation for the inversion signal of the first scan output enable signal and an output signal of the p-th flip-flop DFFp to the (2p−1)-th scan line G2*p*−1. The (2p−1)-th scan line G2*p*−1 refers to an odd scan line.

Figure 4B:
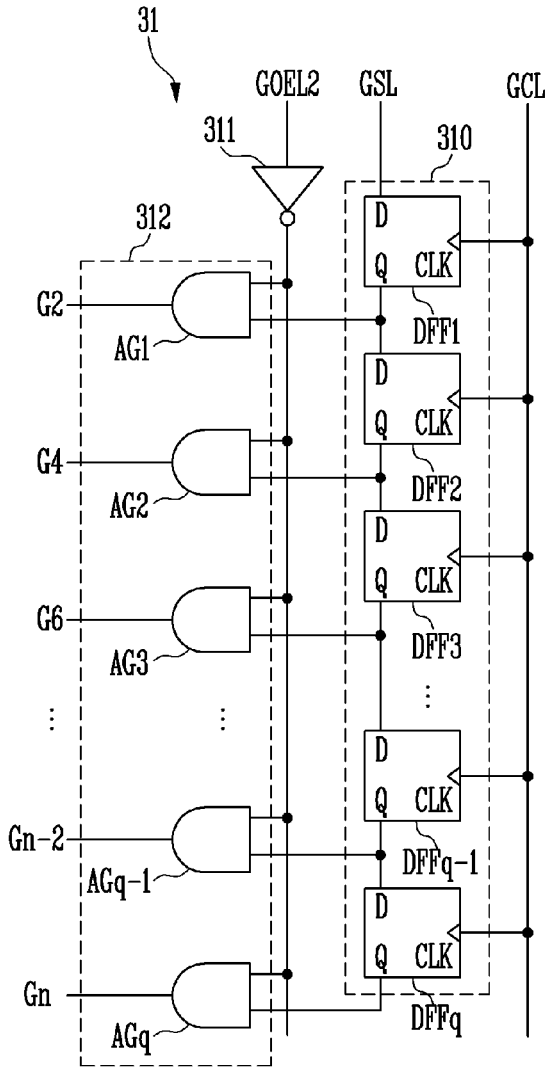

FIG. 4B is a block diagram showing an exemplary embodiment of the second scan drive circuit of FIG. 2. The second scan drive circuit 30 includes a second shift register 31, a second level shifter, a second output buffer, and the like. The second shift register 31 sequentially shifts a scan start signal GST based on a scan clock signal GCLK, and outputs even scan signals based on a second scan output enable signal GOE2 (shown in FIG. 5). The second level shifter converts a swing width of each of the even scan signals to a swing width suitable for driving thin film transistors of the liquid crystal display panel 10. In FIG. 4B, only the second shift register 23 is illustrated for convenience of description.

Referring to FIG. 4A, the second shift register 31 includes a second D flip-flop circuit 310, a second inverter 311 and a second AND gate group 312. The second D flip-flop circuit 310 has first to q-th D flip-flops DFF1 to DFFq, which are connected to each other in a cascade manner. The second AND gate group 312 includes first to q-th AND gates AG1 to AGq.

An input terminal D of a D flip-flop of the second D flip-flop circuit 310 is coupled to scan start signal line GSL to which a scan start signal is supplied or an output terminal Q of a front D flip-flop. A clock terminal CLK of the D flip-flop of the second D flip-flop circuit 310 is coupled to a scan clock signal line GCL to which a scan clock signal is supplied. An output terminal Q of the D flip-flop of the second D flip-flop circuit 310 is coupled to an input terminal of a rear D flip-flop. A front D flip-flop of a p-th D flip-flop DFFp refers to one of first to (p−1)-th D flip-flops DFF1 to DFFp−1. A rear D flip-flop of the p-th D flip-flop DFFp refers to one of (p+1)-th to q-th D flip-flops DFFp+1 to DFFq. Also, an output terminal Q of the p-th D flip-flop DFFp of the second D flip-flop circuit 310 is coupled to a p-th AND gate AGp of the second AND gate group 310. In an exemplary embodiment, as shown in FIG. 4B, an output terminal Q of the first flip-flop DFF1 of the second D flip-flop circuit 310 is coupled to the first AND gate AG1 of the second AND gate group 312.

The second inverter 311 supplies an inversion signal of the second scan output enable signal GOE2 to the second AND gate group 312. The p-th AND gate AGp outputs a result of AND operation for the inversion signal of the second scan output enable signal GOE2 and an output signal of the p-th flip-flop DFFp to a 2p-th scan line G2*p*. The (2p)-th scan line G2*p* refers to an even scan line.

Figure 5:
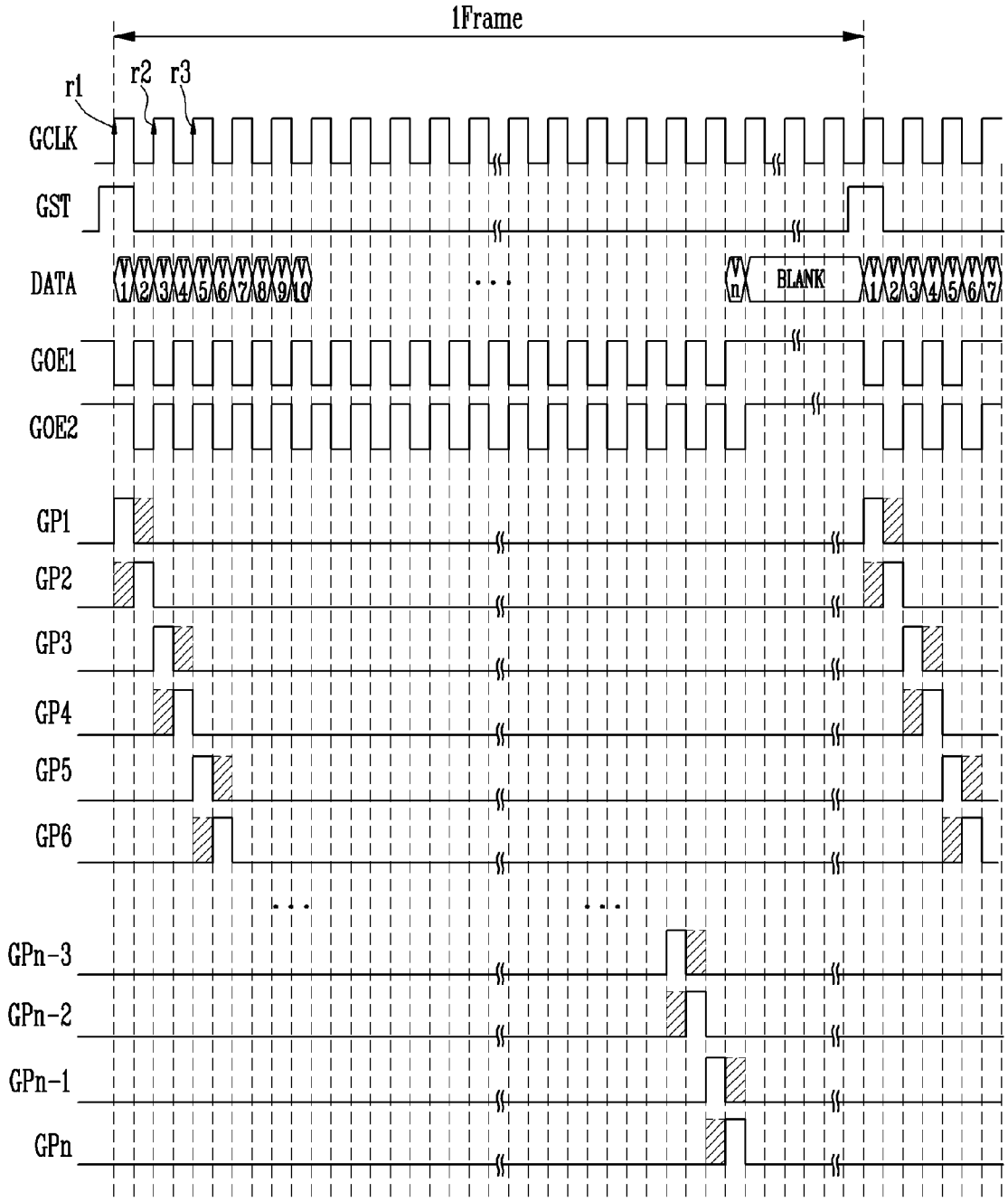
FIG. 5 is a signal timing diagram showing input and output signals of the first and second scan drive circuits of FIGS. 4A and 4B in a sequential addressing ("SA") mode.

FIG. 5 is a signal timing diagram showing input and output signals of the first and second scan drive circuits of FIGS. 4A and 4B in a SA mode. In FIG. 5, a scan clock signal GCLK, a scan start signal GST, first and second scan output enable signals GOE1, GOE2 from the timing controller 50 are illustrated. Also, in FIG. 5, data voltages DATA from the data driver 40, first to sixth scan signals GP1 to GP6, and (n−3)-th to n-th scan signals GPn−3 to GPn are illustrated.

Referring to FIG. 5, a pulse of the scan start signal GST is generated at a start time of a frame period. A pulse cycle of the scan start signal GST may correspond to one frame period, that is may be the same as the period of the frame period. In an exemplary embodiment, a pulse cycle of the scan clock signal GCLK, a pulse cycle of the first scan output enable signal GOE1, a pulse cycle of the second scan output enable signal GOE2 may correspond to two horizontal periods as shown in FIG. 5, but not being limited thereto.

The pulse of the scan clock signal GCLK may be generated during a vertical blank period BLANK. The pulse of the first scan output enable signal GOE1 and the pulse of the second scan output enable signal GOE2 may not be generated during the vertical blank period BLANK. The vertical blank period BLANK refers to a period in which the data voltages DATA are not supplied to the data lines.

In FIG. 5, the data voltages DATA supplied to a data line are illustrated. The data voltages DATA are supplied every one horizontal period. The one horizontal period refers to a scan line scanning period in which data voltages are supplied to pixels coupled to a scan line.

Hereinafter, operation timings of the first and second scan drive circuits 20, 30 and the data driver 40 in the SA mode will be described in detail with reference to FIGS. 4A, 4B and 5.

The first scan drive circuit 20 receives the scan start signal GST, the scan clock signal GCLK and the first scan output enable signal GOE1 from the timing controller 50. The second scan drive circuit 20 receives the scan start signal GST, the scan clock signal GCLK and the second scan output enable signal GOE2 from the timing controller 50.

The first and second D flip-flop circuits 210, 310 of the first and second scan drive circuits 20, 30 sequentially output pulses based on the scan clock signal GCLK in response to the scan start signal GST. The pulses output from the first D flip-flop circuit 210 are substantially the same as the pulses output from the second D flip-flop circuit 310 because the scan start signal GST and the scan clock signal GCLK input to the first scan drive circuit 20 are substantially the same as the scan start signal GST and the scan clock signal GCLK input to the second scan drive circuit 30.

In such an embodiment, the pulse output from the first D flip-flop DFF1 is generated from a first rising edge r1 of the scan clock signal GCLK, which overlaps the pulse of the scan start signal GST, to a second rising edge r2. Also, the pulse output from the second D flip-flop DFF2 is generated from the second rising edge r2 of the scan clock signal GCLK, which overlaps the pulse output from the first D flip-flop DFF1, to a third rising edge r3. A rising edge refers to a time at which the scan clock signal rises from a low logic level to a high logic level. In such an embodiment, the first and second D flip-flop circuits 210, 310 sequentially output pulses based on rising edges of the scan clock signal GCLK, which overlaps the scan start signal GST or a pulse output from the front D flip-flop.

The first scan drive circuit 20 receives the first scan output enable signal GOE1. The second scan drive circuit 30 receives the second scan output enable signal GOE2. A cycle of each of the first and second scan output enable signals GOE1, GOE2 corresponds to two horizontal periods. The first scan output enable signal GOE1 has a low logic level during a (2p−1)-th horizontal period, and has a high logic level during a (2p)-th horizontal period as shown in FIG. 5. The second scan output enable signal GOE2 has a low logic level during the (2p)-th horizontal period, and has a high logic level during the (2p−1)-th horizontal period as shown in FIG. 5. As a result, the first and the second scan drive circuits 20, 30 sequentially output the scan signals GP1 to GPn to the scan lines G1 to Gn as shown in FIG. 5.

The data driver 40 supplies the data voltages DATA, which are synchronized with the scan signals GP1 to GPn, to the data lines D1 to Dm. The data driver 40 may supply first to n-th data voltages V1 to Vn to a data line.

Figure 6:
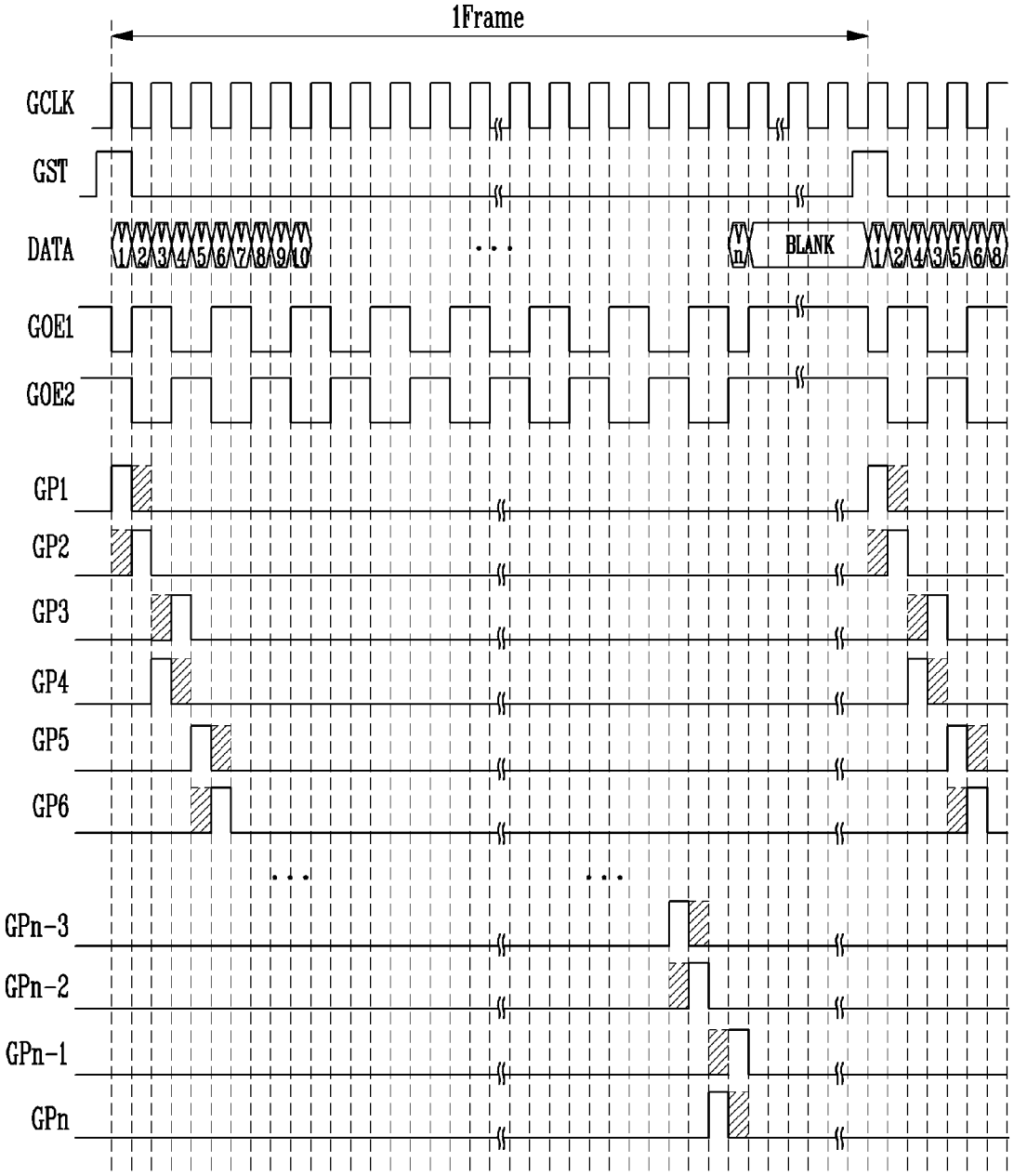
FIG. 6 is a signal timing diagram showing input and output signals of the first and second scan drive circuits of FIGS. 4A and 4B in a transition minimized addressing ("TMA") mode.

FIG. 6 is a signal timing diagram showing input and output signals of the first and second scan drive circuits of FIGS. 4A and 4B in a TMA mode. In FIG. 6, a scan clock signal GCLK, a scan start signal GST, first and second scan output enable signals GOE1, GOE2 from the timing controller 50 are illustrated. Also, in FIG. 6, data voltages DATA from the data driver 40, first to sixth scan signals GP1 to GP6, and (n−3)-th to n-th scan signals GPn−3 to GPn are illustrated.

Referring to FIG. 6, a pulse of the scan start signal GST is generated at a start time of a frame period. A pulse cycle of the scan start signal GST may correspond to one frame period. As shown in FIG. 6, a pulse cycle of the scan clock signal GCLK may be shorter than a pulse cycle of the first scan output enable signal GOE1 and a pulse cycle of the second scan output enable signal GOE2. That is, as shown in FIG. 6, the pulse cycle of the scan clock signal GCLK may correspond to two horizontal periods, and the pulse cycle of the first scan output enable signal GOE1 and the pulse cycle of the second scan output enable signal GOE2 may correspond to four horizontal periods, but not being limited thereto.

The pulse of the scan clock signal GCLK may be generated during a vertical blank period BLANK. The pulse of the first scan output enable signal GOE1 and the pulse of the second scan output enable signal GOE2 may not be generated during the vertical blank period BLANK. Also, the second scan output enable signal GOE2 may be a signal delayed from the first scan output enable signal GOE1, and a phase difference between the first and second scan output enable signals GOE1, GOE2 may be two horizontal periods.

In FIG. 6, the data voltages DATA supplied to a data line are illustrated. The data voltages DATA are supplied every one horizontal period.

Hereinafter, operation timings of the first and second scan drive circuits 20, 30 and the data driver 40 in the TMA mode will be described in detail with reference to FIGS. 4A, 4B and 6.

The first scan drive circuit 20 receives the scan start signal GST, the scan clock signal GCLK and the first scan output enable signal GOE1 from the timing controller 50. The second scan drive circuit 20 receives the scan start signal GST, the scan clock signal GCLK and the second scan output enable signal GOE2 from the timing controller 50.

The first and second D flip-flop circuits 210, 310 of the first and second scan drive circuits 20, 30 sequentially output pulses based on the scan clock signal GCLK in response to scan start signal GST. The pulses output from the first D flip-flop circuit 210 are substantially the same as the pulses output from the second D flip-flop circuit 310 because the scan start signal GST and the scan clock signal GCLK input to the first scan drive circuit 20 are substantially the same as the scan start signal GST and the scan clock signal GCLK input to the second scan drive circuit 30.

The first scan drive circuit 20 receives the first scan output enable signal GOE1. The second scan drive circuit 30 receives the second scan output enable signal GOE2. The first scan output enable signal GOE1 has a low logic level during (4r−3)-th and (4r)-th horizontal periods, and has a high logic level during (4r−2)-th and (4r−1)-th horizontal periods as shown in FIG. 6. The second scan output enable signal GOE2 has a low logic level during (4r−2)-th and (4r−1)-th horizontal periods, and has a high logic level during (4r−3)-th and (4r)-th horizontal periods as shown in FIG. 6.

As a result, the first and the second scan drive circuits 20, 30 may output the scan signals GP1 to GPn in the order of (4r−3)-th, (4r−2)-th, (4r)-th and (4r−1)-th scan signals to the scan lines G1 to Gn as shown in FIG. 5. In one exemplary embodiment, for example, the first and the second scan drive circuits 20, 30 may output first to fourth scan signals GP1 to GP4 in the order of first, second, fourth and third scan signals to first to fourth scan lines G1 to G4. Also, the first and second scan drive circuits 20, 30 may output the scan signals GP1 to GPn by a unit of four scan signals. In one exemplary embodiment, for example, the first and second scan drive circuits 20, 30 may output the first to fourth scan signals GP1 to GP4 in a predetermined order, and then output the fifth to eighth scan signals GP5 to GP8 in the predetermined order. In such an embodiment, the first and second scan drive circuits 20, 30 may output the scan signals GP1 to GPn in the predetermined order to the scan lines G1 to Gn using the first and second scan output enable signals GOE1, GOE2.

The data driver 40 supplies the data voltages DATA, which are synchronized with the scan signals GP1 to GPn to, the data lines D1 to Dm. The data driver 40 may supply first to n-th data voltages V1 to Vn in the order of outputting the scan signals GP1 to GPn to a data line. That is, the data driver 40 may supply first to n-th data voltages V1 to Vn in the order of the (4r−3)-th, (4r−2)-th, (4r)-th and (4r−1)-th data voltages when the first and second scan drive circuits 20, 30 output the scan signals GP1 to GPn in the order of (4r−3)-th, (4r−2)-th, (4r)-th and (4r−1)-th scan signals. In one exemplary embodiment, for example, the data driver 40 may supply first to fourth data voltages V1 to V4 in the order of first, second, fourth and the third data voltages.

In an exemplary embodiment, the operation timings of the first and second scan drive circuits 20, 30 and the data driver 40 may be controlled based on one of the SA mode and the TMA mode by controlling the first and second output enable signals GOE1, GOE2. As a result, in such an embodiment, the operation timings of the first and second scan drive circuits 20, 30 and the data driver 40 may be controlled based on the TMA mode when a predetermined image pattern such as the horizontal stripe pattern is displayed in the liquid crystal display panel 10. Therefore, in such an embodiment, power consumption is substantially reduced by minimizing a swing cycle of the data voltages when the predetermined image pattern is displayed in the liquid crystal display panel 10.

Also, in such an embodiment, the operation timings of the first and second scan drive circuits 20, 30 and the data driver 40 may be controlled based on one of the SA mode and the TMA mode using only four signals, e.g., the scan start signal GST, the scan clock signal GCLK and the first and second scan output enable signals GOE1, GOE2, such that the number of the signal lines for connecting the timing controller 50 with the first and second scan drive circuits 20, 30 may be effectively minimized.

Figure 7:
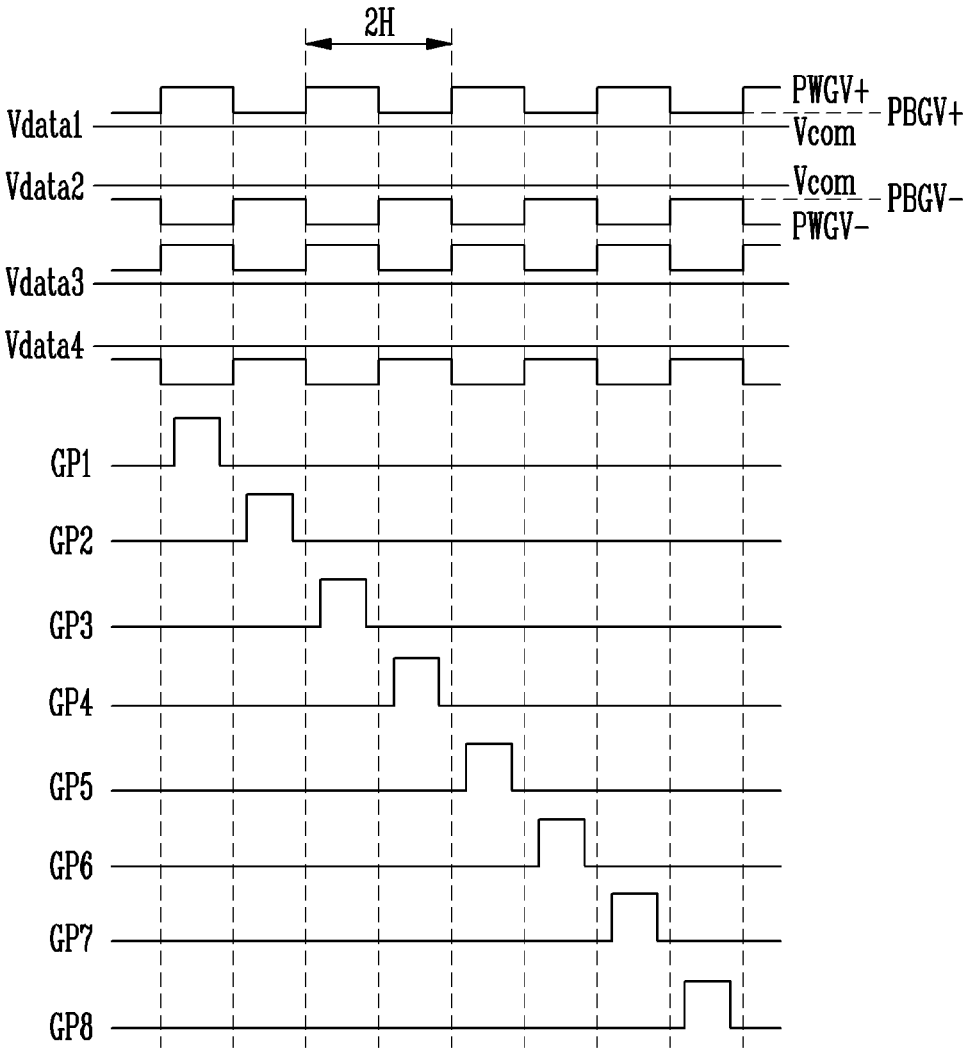
FIG. 7 is a diagram illustrating first to eight scan signals and first to fourth data voltages in a SA mode of FIG. 5.

FIG. 7 is a diagram illustrating first to eight scan signals and first to fourth data voltages in a SA mode of FIG. 5. Referring FIG. 7, in an exemplary embodiment, the data driver 40 supplies data voltages to data lines in the column inversion method. Therefore, a polarity of data voltages supplied to the j-th data line Dj is opposite to a polarity of data voltages supplied to the (j−1)-th and (j+1)-th data lines Dj−1, Dj+1.

Also, a swing cycle of data voltages supplied to data lines corresponds to two horizontal periods 2H in a case where the scan signals are sequentially supplied to the scan lines in the SA mode when the horizontal stripe pattern is displayed in the liquid crystal display panel. In one exemplary embodiment, for example, as shown in FIG. 7, data voltages Vdata1 supplied to a first data line D1 swing between a positive peak white gray level voltage PWGV+ and a positive peak black gray level voltage PBGV+ every two horizontal periods. Also, data voltages Vdata2 supplied to a second data line D2 swings between a negative peak white gray level voltage PWGV− and a negative peak black gray level voltage PBGV− every two horizontal periods. The horizontal stripe pattern refers an image pattern displayed when pixels coupled to odd scan lines display a peak white gray level and pixels coupled to even scan lines display a peak black gray level.

Figure 8:
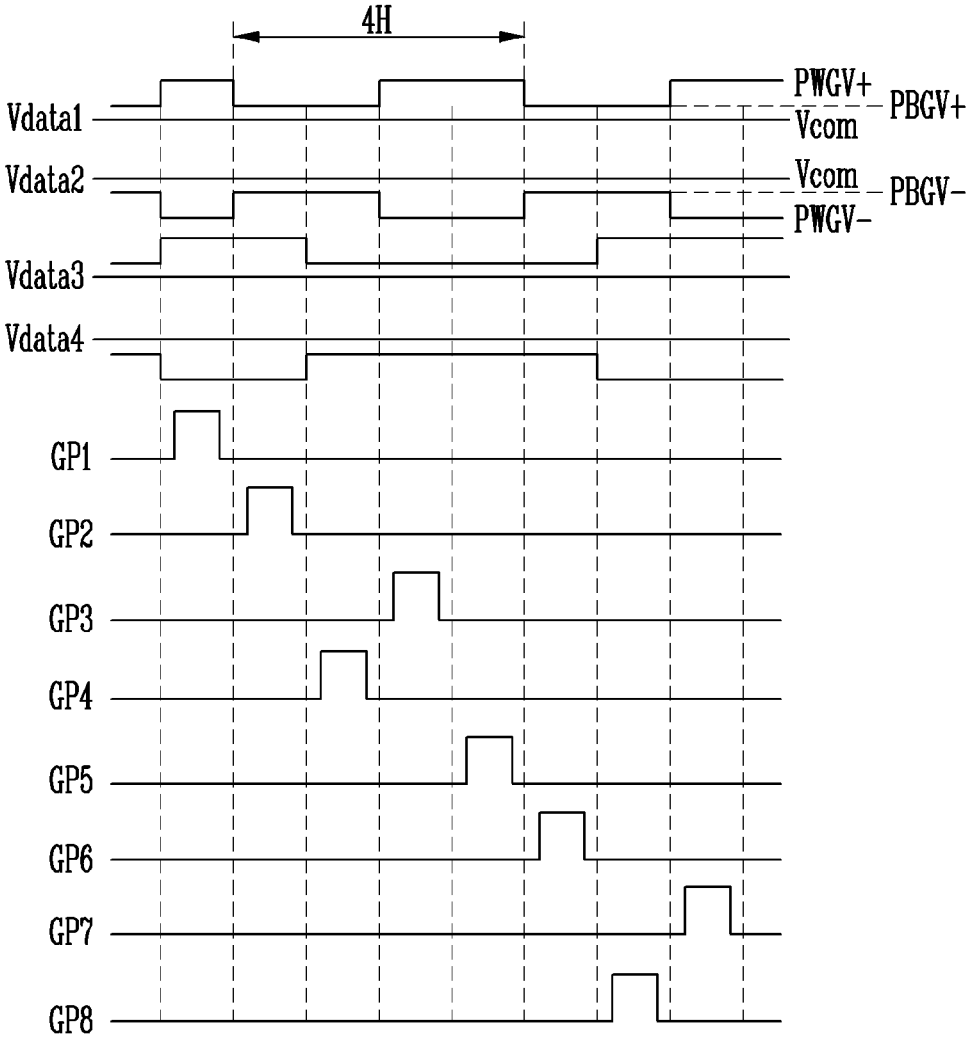
FIG. 8 is a diagram illustrating first to eight scan signals and first to fourth data voltages in a TMA mode of FIG. 6.

FIG. 8 is a diagram illustrating first to eight scan signals and first to fourth data voltages in a TMA mode of FIG. 6. Referring to FIG. 8, the data driver 40 supplies data voltages to data lines in the column inversion method. Therefore, a polarity of data voltages supplied to the j-th data line Dj is opposite to a polarity of data voltages supplied to the (j−1)-th and (j+1)-th data lines Dj−1, Dj+1.

Also, a swing cycle of data voltages supplied to data lines correspond to four horizontal periods 4H in a case where the scan signals are supplied to the scan lines in a predetermined order in the TMA mode when the horizontal stripe pattern is displayed in the liquid crystal display panel. In one exemplary embodiment, for example, as shown in FIG. 8, data voltages Vdata1 supplied to a first data line D1 swing between a positive peak white gray level voltage PWGV+ and a positive peak black gray level voltage PBGV+ every four horizontal periods. Also, data voltages Vdata2 supplied to a second data line D2 swing between a negative peak white gray level voltage PWGV− and a negative peak black gray level voltage PBGV− every four horizontal periods. In FIG. 8, the scan signals supplied to scan lines in the order of (4r−3)-th, (4r−2)-th, (4r)-th and (4r−1)-th scan signals are illustrated.

In an exemplary embodiment, a swing cycle of the data voltages in the TMA mode is longer than in the SA mode when the horizontal stripe pattern is displayed in the liquid crystal display panel 10 such that power consumption of the liquid crystal display is decreased. Here, the horizontal stripe pattern is an example of a predetermined image pattern. In such an embodiment, the predetermined image pattern may be an image pattern that increases power consumption of the liquid crystal display panel 10 in the SA mode.

Figure 9A:
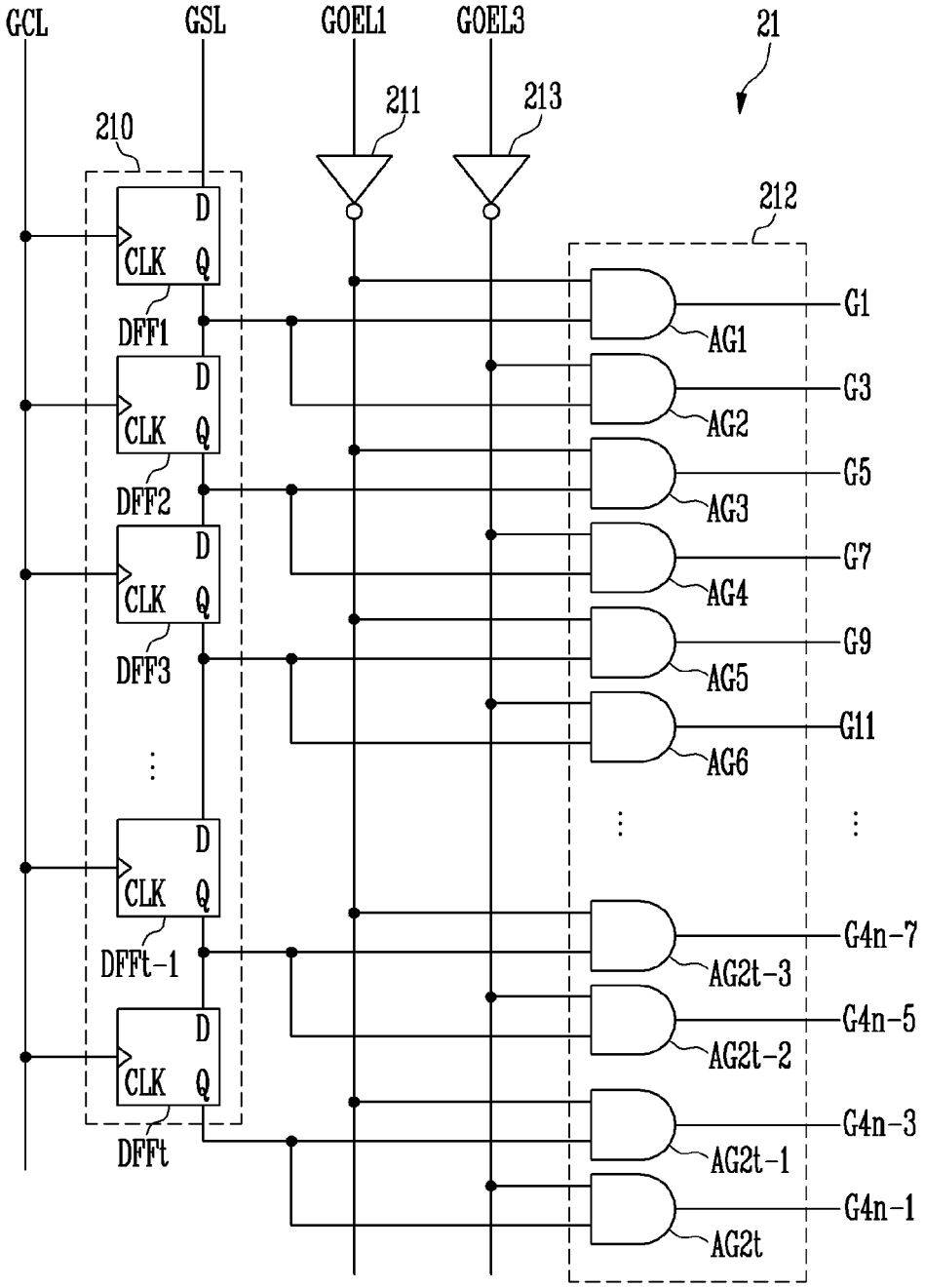
FIGS. 9A and 9B are block diagrams showing an alternative exemplary embodiment of first and second scan drive circuits of FIG. 2.

FIG. 9A is a block diagram showing an alternative exemplary embodiment of first scan drive circuit of FIG. 2. The first scan drive circuit 20 includes a first shift register 21, a first level shifter, a first output buffer, and the like, for example. The first shift register 21 sequentially shifts a scan start signal GST based on a scan clock signal GCLK, and outputs odd scan signals based on first and third scan output enable signals GOE1, GOE3 (shown in FIG. 10). The first level shifter converts a swing width of each of the odd scan signals to a swing width suitable for driving thin film transistors of the liquid crystal display panel 10. Only the first shift register 21 is illustrated in FIG. 9A for convenience of description.

Referring to FIG. 9A, the first shift register 21 includes a first D flip-flop circuit 210, a first inverter 211, first AND gate group 212 and a third inverter 213. The first D flip-flop circuit 210 has first to t-th D flip-flops DFF1 to DFFt (t is a positive integer satisfying the following inequation: $t \leq 4n$) connected to each other in a cascade manner. The first AND gate group 212 includes first to (2t)-th AND gates AG1 to AG2*t*.

An input terminal D of a D flip-flop of the first D flip-flop circuit 210 is coupled to scan start signal line GSTL to which a scan start signal is supplied or an output terminal Q of a front D flip-flop. A clock terminal CLK of the D flip-flop of the first D flip-flop circuit 210 is coupled to a scan clock signal line GCLK to which a scan clock signal is supplied. An output terminal Q of the D flip-flop of the first D flip-flop circuit 210 is coupled to an input terminal of a rear D flip-flop. A front D flip-flop of a u-th D flip-flop DFFu (u is a positive integer satisfying the following inequation: $1 \leq u \leq t$) refers to one of first to (u−1)-th D flip-flops DFF1 to DFFu−1. A rear D flip-flop of the u-th D flip-flop DFFp refers to one of (u+1)-th to u-th D flip-flops DFFu+1 to DFFt. Also, an output terminal Q of the u-th D flip-flop DFFu of the first D flip-flop circuit 210 is coupled to (2u−1)-th and (2u)-th AND gates AG2*u*−1, AG2*u*. In one exemplary embodiment, for example, an output terminal Q of the first flip-flop DFF1 of the first D flip-flop circuit 210 is coupled to first and second AND gates AG1, AG2.

The first inverter 211 supplies an inversion signal of the first scan output enable signal GOE1 to the first AND gate group 212. The third inverter 213 supplies an inversion signal of the third scan output enable signal GOE3 to the first AND gate group 212.

The (2u−1)-th AND gate AG2*u*−1 of the first AND gate group 212 outputs a result of AND operation for the inversion signal of the first scan output enable signal GOE1 and an output signal of the u-th flip-flop DFFu to a (4u−3)-th scan line G4*u*−3. In one exemplary embodiment, for example, the first AND gate AG1 of the first AND gate group 212 outputs a result of AND operation for the inversion signal of the first scan output enable signal GOE1 and an output signal of the first flip-flop DFF1 to a first scan line G1. The (2u)-th AND gate AG2*u* of the first AND gate group 212 outputs a result of AND operation for the inversion signal of the third scan output enable signal GOE3 and an output signal of the u-th flip-flop DFFu to a (4u−1)-th scan line G4*u*−1. In one exemplary embodiment, for example, the second AND gate AG2 of the first AND gate group 212 outputs a result of AND operation for the inversion signal of the third scan output enable signal GOE3 and an output signal of the first flip-flop DFF1 to a second scan line G2. The (2u−1)-th AND gate refers to an odd AND gate, and the (2u)-th AND gate refers to an even AND gate.

Figure 9B:
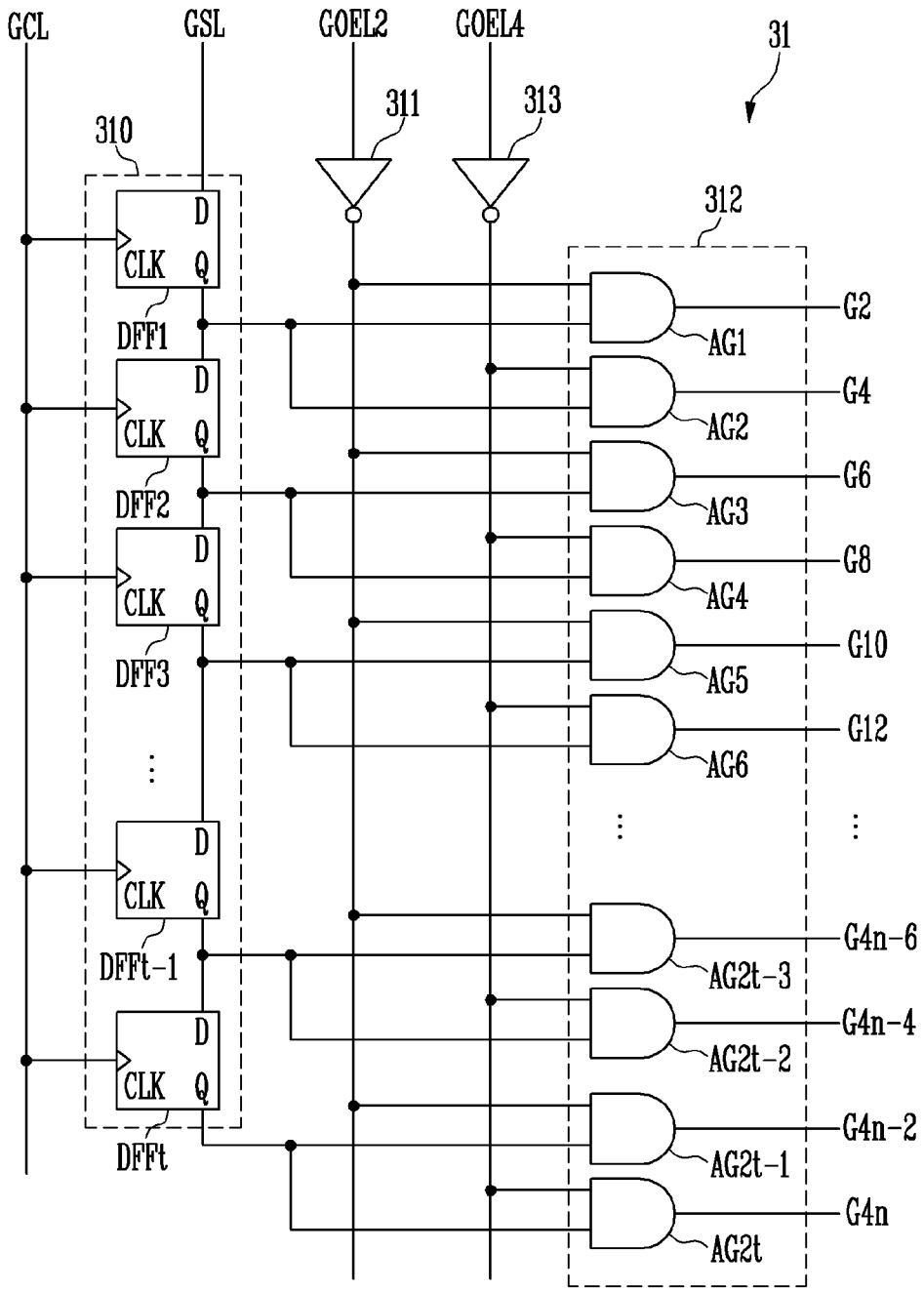

FIG. 9B is a block diagram showing an alternative exemplary embodiment of second scan drive circuit of FIG. 2. The second scan drive circuit 30 includes a second shift register 31, a second level shifter, a second output buffer, and the like. The second shift register 31 sequentially shifts a scan start signal GST based on a scan clock signal GCLK, and outputs even scan signals based on second and fourth scan output enable signals GOE2, GOE4 (shown in FIG. 10). The second level shifter converts a swing width of each of the even scan signals to a swing width suitable for driving thin film transistors of the liquid crystal display panel 10. Only the second shift register 31 is illustrated in FIG. 9B for convenience of description.

Referring to FIG. 9B, the second shift register 31 includes a second flip-flop circuit 310, a second inverter 311, second AND gate group 312 and a fourth inverter 313. The second D flip-flop circuit 310 has first to t-th D flip-flops DFF1 to DFFt, which are connected to each other in a cascade manner. The second AND gate group 312 includes first to (2t)-th AND gates AG1 to AG2*t*.

An input terminal D of a D flip-flop of the second D flip-flop circuit 310 is coupled to scan start signal line GSTL to which a scan start signal is supplied or an output terminal Q of a front D flip-flop. A clock terminal CLK of the D flip-flop of the second D flip-flop circuit 310 is coupled to a scan clock signal line GCLK to which a scan clock signal is supplied. An output terminal Q of the D flip-flop of the second D flip-flop circuit 310 is coupled to an input terminal of a rear D flip-flop. Also, an output terminal Q of the u-th D flip-flop DFFu of the second D flip-flop circuit 310 is coupled to (2u−1)-th and (2u)-th AND gates AG2*u*−1, AG2*u*. In one exemplary embodiment, for example, an output terminal Q of the first flip-flop DFF1 of the second D flip-flop circuit 310 is coupled to first and second AND gates AG1, AG2.

The second inverter 311 supplies an inversion signal of the second scan output enable signal GOE2 to the second AND gate group 312. The fourth inverter 313 supplies an inversion signal of the fourth scan output enable signal GOE4 to the second AND gate group 312.

The (2u−1)-th AND gate AG2*u*−1 of the second AND gate group 312 outputs a result of AND operation for the inversion signal of the second scan output enable signal GOE2 and an output signal of the u-th flip-flop DFFu to a (4u−2)-th scan line G4*u*−2. In one exemplary embodiment, for example, the first AND gate AG1 of the second AND gate group 312 outputs a result of AND operation for the inversion signal of the second scan output enable signal GOE2 and an output signal of the first flip-flop DFF1 to a second scan line G2. The (2u)-th AND gate AG2*u* of the second AND gate group 312 outputs a result of AND operation for the inversion signal of the fourth scan output enable signal GOE4 and an output signal of the u-th flip-flop DFFu to a (4u)-th scan line G4*u*. In one exemplary embodiment, for example, the second AND gate AG2 of the second AND gate group 312 outputs a result of AND operation for the inversion signal of the fourth scan output enable signal GOE4 and an output signal of the first flip-flop DFF1 to a fourth scan line G4.

Figure 10:
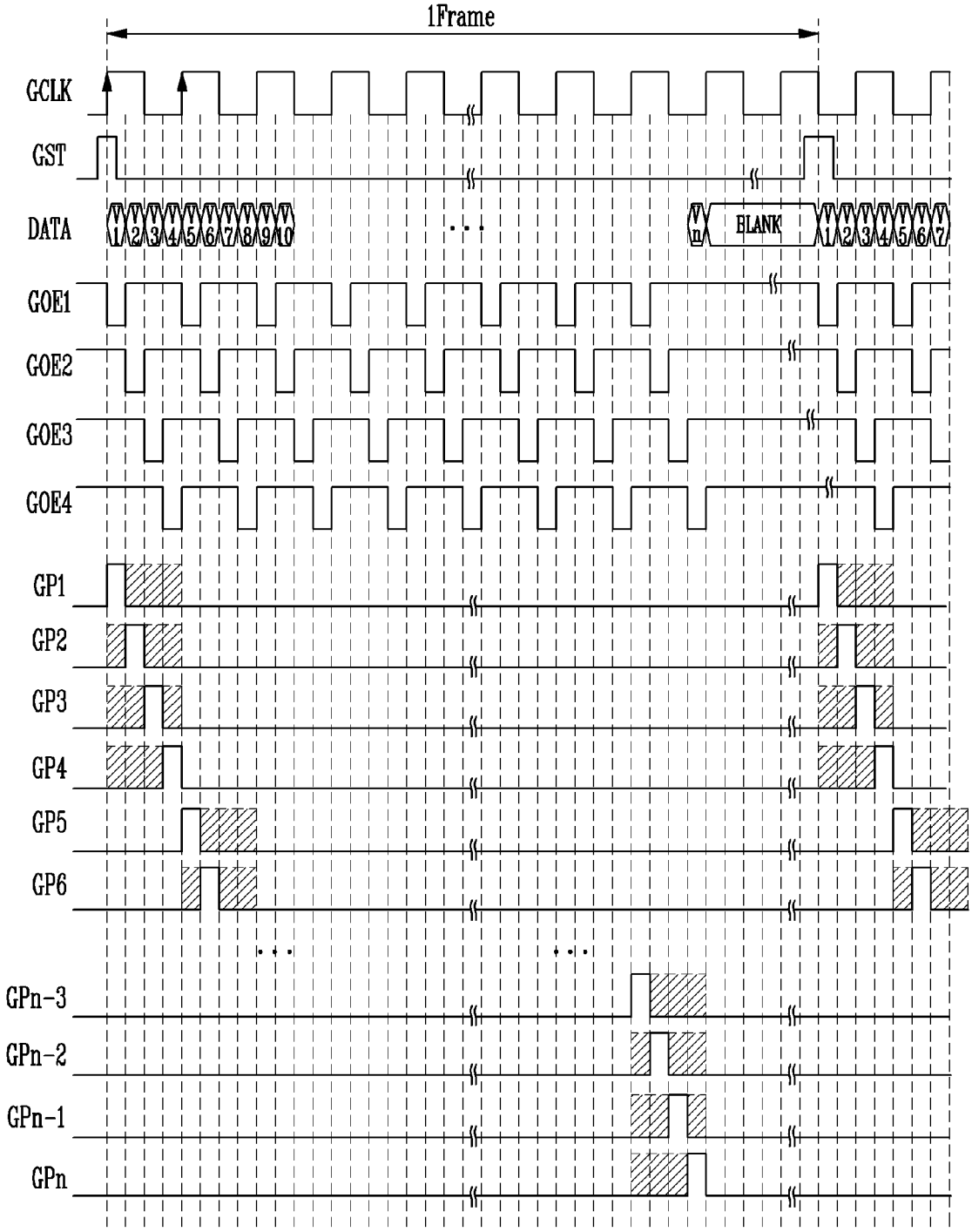
FIG. 10 is a waveform diagram showing input and output signals of the first and second scan drive circuits of FIGS. 9A and 9B in a SA mode.

FIG. 10 is a signal timing diagram showing input and output signals of first and second scan drive circuits of FIGS. 9A and 9B in a SA mode. In FIG. 10, a scan clock signal GCLK, a scan start signal GST, and first to fourth scan output enable signals GOE1 to GOE4 from the timing controller 50 are illustrated. Also, in FIG. 10, data voltages DATA from the data driver 40, first to sixth scan signals GP1 to GP6, and (n−3)-th to n-th scan signals GPn−3 to GPn are illustrated.

Referring to FIG. 10, a pulse of the scan start signal GST is generated at a start time of a frame period. A pulse cycle of the scan start signal GST may correspond to one frame period. A pulse cycle of the scan clock signal GCLK, a pulse cycle of each of the first to fourth scan output enable signals GOE1 to GOE4 may correspond to four horizontal periods in FIG. 10, but not being limited thereto.

The pulse of the scan clock signal GCLK may be generated during a vertical blank period BLANK. The pulse of each of the first to fourth scan output enable signals GOE1 to GOE4 may not be generated during the vertical blank period BLANK. Also, the second scan output enable signal GOE2 may be a signal delayed from the first scan output enable signal GOE1, and a phase difference between the first and second scan output enable signals GOE1, GOE2 may be one horizontal period as shown in FIG. 10. The third scan output enable signal GOE3 may be a signal delayed from the second scan output enable signal GOE2, and a phase difference between the second and third scan output enable signals GOE2, GOE3 may be one horizontal period as shown in FIG. 10. The fourth scan output enable signal GOE4 may be a signal delayed from the third scan output enable signal GOE3, and a phase difference between the third and fourth scan output enable signals GOE3, GOE4 may be one horizontal period as shown in FIG. 10.

In FIG. 10, the data voltages DATA supplied to a data line are illustrated. The data voltages DATA are supplied every one horizontal period.

Hereinafter, an operation of the first and second scan drive circuits 20, 30 and the data driver 40 in the SA mode will be described in detail with reference to FIGS. 9A, 9B and 10.

The first scan drive circuit 20 receives the scan start signal GST, the scan clock signal GCLK, and the first and third scan output enable signals GOE1, GOE3 from the timing controller 50. The second scan drive circuit 20 receives the scan start signal GST, the scan clock signal GCLK, and the second and fourth scan output enable signal GOE2, GOE4 from the timing controller 50.

The first and second D flip-flop circuits 210, 310 of the first and second scan drive circuits 20, 30 sequentially output pulses based on the scan clock signal GCLK in response to scan start signal GST. The pulses output from the first D flip-flop circuit 210 are substantially the same as the pulses output from the second D flip-flop circuit 310 because the scan start signal GST and the scan clock signal GCLK input to the first scan drive circuit 20 are substantially the same as the scan start signal GST and the scan clock signal GCLK input to the second scan drive circuit 30.

The first scan drive circuit 20 receives the first and third scan output enable signals GOE1, GOE3. The second scan drive circuit 30 receives the second and fourth scan output enable signal GOE2, GOE4. A cycle of each of the first to fourth scan output enable signals GOE1 to GOE4 correspond to four horizontal periods. The first scan output enable signal GOE1 has a low logic level during a (4p−3)-th horizontal period, and has a high logic level during (4r−2)-th to (4r)-th horizontal periods as shown in FIG. 10. The second scan output enable signal GOE2 has a low logic level during a (4r−2)-th horizontal period, and has a high logic level during (4r−3)-th, (4r−1)-th and (4r)-th horizontal periods as shown in FIG. 10. The third scan output enable signal GOE3 has a low logic level during a (4r−1)-th horizontal period, and has a high logic level during (4r−3)-th, (4r−2)-th and (4r)-th horizontal periods as shown in FIG. 10. The fourth scan output enable signal GOE4 has a low logic level during a (4r)-th horizontal period, and has a high logic level during (4r−3)-th to (4r−1)-th horizontal periods as shown in FIG. 10. As a result, the first and the second scan drive circuits 20, 30 sequentially output the scan signals GP1 to GPn to the scan lines G1 to Gn as shown in FIG. 10.

The data driver 40 supplies the data voltages DATA, which are synchronized with the scan signals GP1 to GPn, to the data lines D1 to Dm. The data driver 40 may supply first to n-th data voltages V1 to Vn to a data line.

Figure 11:
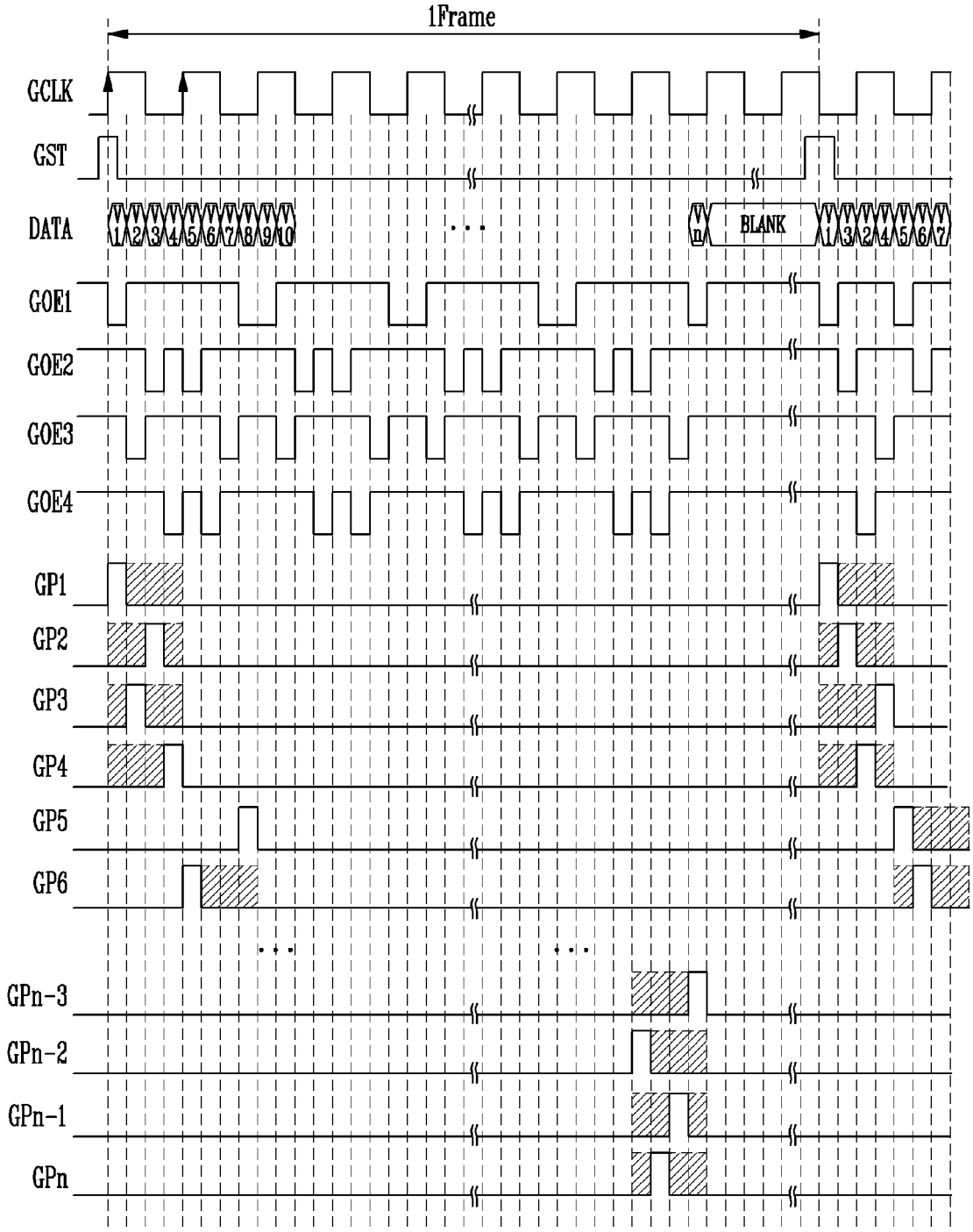
FIG. 11 is a waveform diagram showing input and output signals of the first and second scan drive circuits of FIGS. 9A and 9B in a TMA mode.

FIG. 11 is a signal timing diagram showing input and output signals of first and second scan drive circuits of FIGS. 9A and 9B in a TMA mode. In FIG. 11, a scan clock signal GCLK, a scan start signal GST, and first to fourth scan output enable signals GOE1 to GOE4 from the timing controller 50 are illustrated. Also, in FIG. 11, data voltages DATA from the data driver 40, first to sixth scan signals GP1 to GP6, and (n−3)-th to n-th scan signals GPn−3 to GPn are illustrated.

Referring to FIG. 11, a pulse of the scan start signal GST is generated at a start time of a frame period. A pulse cycle of the scan start signal GST may correspond to one frame period. As shown in FIG. 11, a pulse cycle of the scan clock signal GCLK may be shorter than a pulse cycle of each of the first to fourth scan output enable signals GOE1 to GOE4. That is, as shown in FIG. 11, the pulse cycle of the scan clock signal GCLK may correspond to four horizontal periods, and the pulse cycle of each of the first to fourth scan output enable signals GOE1 to GOE4 may correspond to eight horizontal periods, but not being limited thereto.

The pulse of the scan clock signal GCLK may be generated during a vertical blank period BLANK. The pulse of each of the first to fourth scan output enable signals GOE1 to GOE4 may not be generated during the vertical blank period BLANK.

In FIG. 11, the data voltages DATA supplied to a data line are illustrated. The data voltages DATA are supplied every one horizontal period.

Hereinafter, operation timings of the first and second scan drive circuits 20, 30 and the data driver 40 in the TMA mode will be described in detail with reference to FIGS. 9A, 9B and 11.

The first scan drive circuit 20 receives the scan start signal GST, the scan clock signal GCLK, and the first and third scan output enable signals GOE1, GOE3 from the timing controller 50. The second scan drive circuit 20 receives the scan start signal GST, the scan clock signal GCLK, and the second and fourth scan output enable signals GOE2, GOE4 from the timing controller 50.

The first and second D flip-flop circuits 210, 310 of the first and second scan drive circuits 20, 30 sequentially output pulses according to the scan clock signal GCLK in response to scan start signal GST. The pulses output from the first D flip-flop circuit 210 are substantially the same as the pulses output from the second D flip-flop circuit 310 because the scan start signal GST and the scan clock signal GCLK input to the first scan drive circuit 20 are substantially the same as the scan start signal GST and the scan clock signal GCLK input to the second scan drive circuit 30.

The first scan drive circuit 20 receives the first and third scan output enable signals GOE1, GOE3. The second scan drive circuit 30 receives the second and fourth scan output enable signals GOE2, GOE4. The first scan output enable signal GOE1 has a low logic level during (8s−7)-th and (8s)-th (s is a positive integer) horizontal periods, and has a high logic level during (8s−6)-th to (8s−1)-th horizontal periods as shown in FIG. 11. The second scan output enable signal GOE2 has a low logic level during (8s−5)-th and (8s−3)-th horizontal periods, and has a high logic level during (8s−7)-th, (8s−6)-th, (8s−4)-th and (8s−2)-th to (8s)-th horizontal periods as shown in FIG. 11. The third scan output enable signal GOE3 has a low logic level during (8s−6)-th and (8s−1)-th horizontal periods, and has a high logic level during (8s−7)-th, (8s−4)-th to (8s−2)-th and (8s)-th horizontal periods as shown in FIG. 11. The fourth scan output enable signal GOE4 has a low logic level during (8s−4)-th and (8s−2)-th horizontal periods, and has a high logic level during (8s−7)-th to (8s−5)-th, (8s−3)-th, (8s−1)-th and (8s)-th horizontal periods as shown in FIG. 11.

The first and second scan drive circuits 20, 30 may output scan signals to scan lines in the order of (8s−7)-th, (8s−5)-th, (8s−6)-th, (8s−4)-th, (8s−2)-th, (8s)-th, (8s−1)-th and (8s−3)-th scan signals. In one exemplary embodiment, for example, the first and second scan drive circuits 20, 30 may output first to eighth scan signals GP1 to GP8 to first to eighth scan lines G1 to G8 in the order of first, third, second, fourth, sixth, eighth, seventh and fifth scan signals. Also, the first and second scan drive circuits 20, 30 may output the scan signals GP1 to GPn by a unit of eight scan signals. In one exemplary embodiment, for example, the first and second scan drive circuits 20, 30 may output the first to eighth scan signals GP1 to GP8 in a predetermined order, and then output the ninth to sixteenth scan signals GP9 to GP16 in the predetermined order. That is, the first and second scan drive circuits 20, 30 may output the scan signals GP1 to GPn in the predetermined order to the scan lines G1 to Gn using the first to fourth scan output enable signals GOE1 to GOE4.

The data driver 40 supplies the data voltages DATA, which are synchronized with the scan signals GP1 to GPn, to the data lines D1 to Dm. The data driver 40 may supply first to n-th data voltages V1 to Vn in the order of outputting the scan signals GP1 to GPn to a data line. That is, the data driver 40 may supply first to n-th data voltages V1 to Vn in the order of the (8s−7)-th, (8s−5)-th, (8s−6)-th, (8s−4)-th, (8s−2)-th, (8s)-th, (8s−1)-th and (8s−3)-th data voltages when the first and second scan drive circuits 20, 30 output the scan signals GP1 to GPn in the order of the (8s−7)-th, (8s−5)-th, (8s−6)-th, (8s−4)-th, (8s−2)-th, (8s)-th, (8s−1)-th and (8s−3)-th scan signals. In one exemplary embodiment, for example, the data driver 40 may supply first to eighth data voltages V1 to V8 in the order of first, third, second, fourth, sixth, eighth, seventh and fifth data voltages.

In such an embodiment, the operation timings of the first and second scan drive circuits 20, 30 and the data driver 40 may be controlled based on one of the SA mode and the TMA mode by controlling the first to fourth output enable signals GOE1 to GOE4. As a result, in such an embodiment, the operation timings of the first and second scan drive circuits 20, 30 and the data driver 40 may be controlled based on the TMA mode when the predetermined image pattern such as the horizontal stripe pattern is displayed in the liquid crystal display panel 10. Therefore, in such an embodiment, power consumption may be reduced by minimizing a swing cycle of the data voltages when the predetermined image pattern is displayed in the liquid crystal display panel 10.

Figure 12:
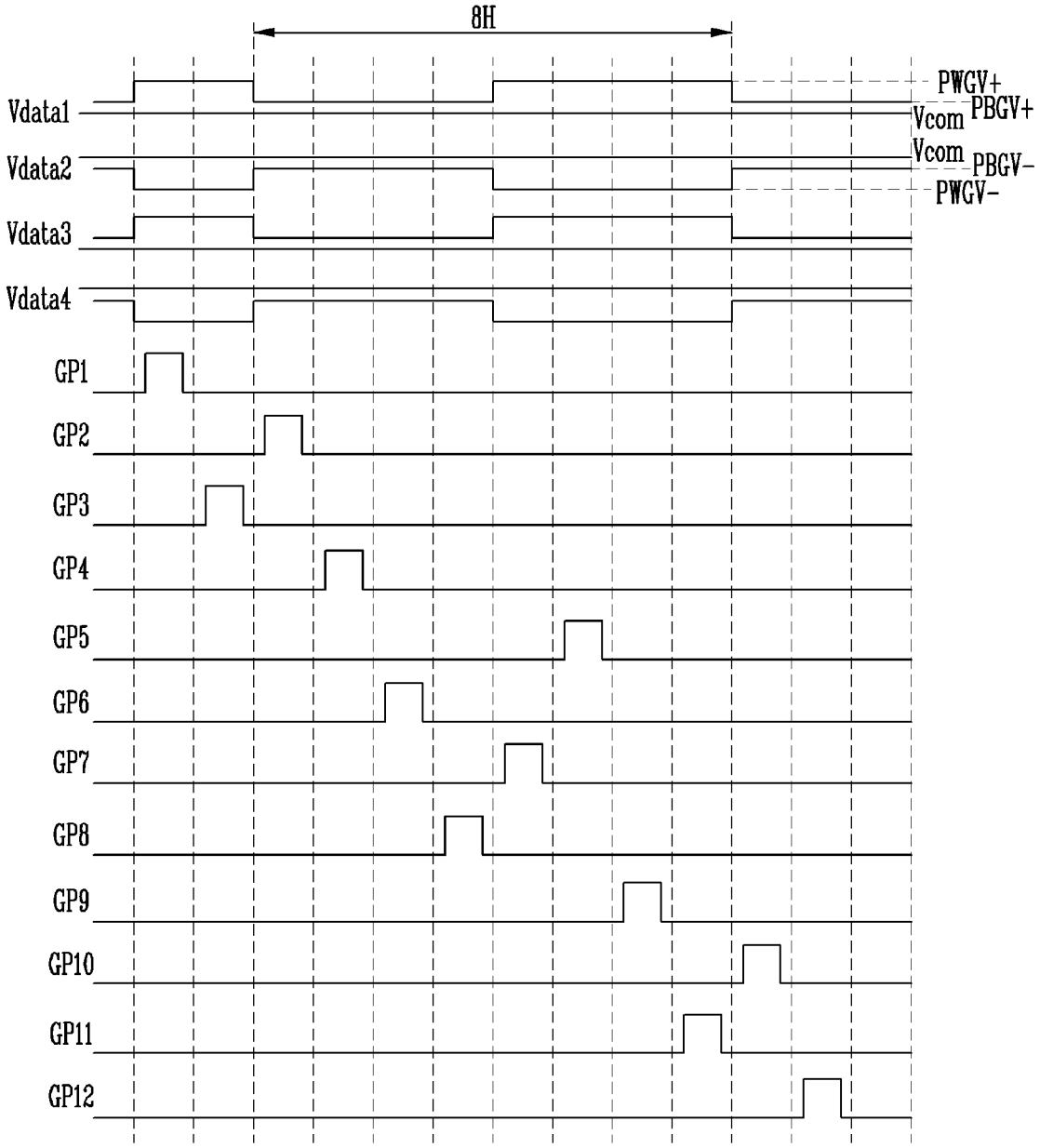
FIG. 12 is a diagram illustrating first to eight scan signals and first to fourth data voltages in a TMA mode of FIG. 11.

FIG. 12 is a diagram illustrating first to eight scan signals and first to fourth data voltages in a TMA mode of FIG. 11. The first to eight scan signals and first to fourth data voltages in the SA mode of FIG. 10 are substantially the same as first to eight scan signals and first to fourth data voltages in the SA mode of FIG. 7. Therefore, any repetitive detailed description of the first to eight scan signals and the first to fourth data voltages in the SA mode of FIG. 10 will be omitted.

Referring to FIG. 12, the data driver 40 supplies data voltages to data lines in the column inversion method. Therefore, a polarity of data voltages supplied to the j-th data line Dj is opposite to a polarity of data voltages supplied to the (j−1)-th and (j+1)-th data lines Dj−1, Dj+1.

Also, a swing cycle of data voltages supplied to data lines correspond to four horizontal periods 8H in the case where the scan signals are supplied to the scan lines in a predetermined order in the TMA mode when the horizontal stripe pattern is displayed in the liquid crystal display panel. In one exemplary embodiment, for example, as shown in FIG. 11, data voltages Vdata1 supplied to a first data line D1 swing between a positive peak white gray level voltage PWGV+ and a positive peak black gray level voltage PBGV+ every eight horizontal periods. Also, data voltages Vdata2 supplied to a second data line D2 swing between a negative peak white gray level voltage PWGV− and a negative peak black gray level voltage PBGV− every eight horizontal periods. In FIG. 11, the scan signals supplied to scan lines in the order of (8s−7)-th, (8s−5)-th, (8s−6)-th, (8s−4)-th, (8s−2)-th, (8s)-th, (8s−1)-th and (8s−3)-th scan signals are illustrated.

In such an embodiment, a swing cycle of the data voltages in the TMA mode is longer than in the SA mode when the horizontal stripe pattern is displayed in the liquid crystal display panel 10 such that power consumption of the liquid crystal display is decreased. Here, the horizontal stripe pattern is merely an example of the predetermined image pattern. In an exemplary embodiment, the predetermined image pattern may be an image pattern that increases power consumption of the liquid crystal display panel 10 in the SA mode.

Figure 13:
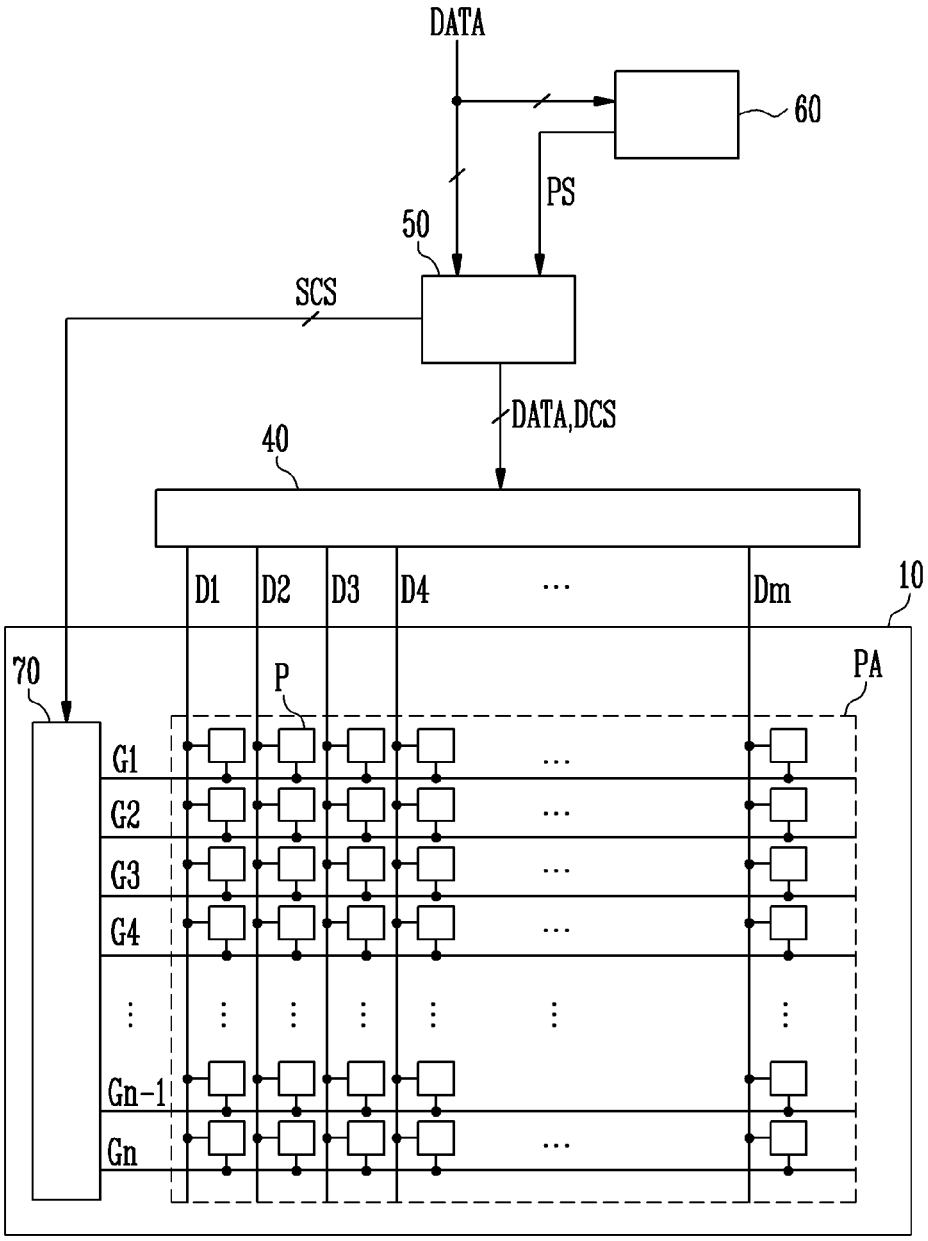
FIG. 13 is a block diagram showing an alternative exemplary embodiment of a liquid crystal display according to the invention.

FIG. 13 is a block diagram showing an alternative exemplary embodiment of a liquid crystal display according to the invention. Referring to FIG. 13, an exemplary embodiment of the liquid crystal display includes a liquid crystal display panel 10 in which a pixel array PA is disposed, a scan driver, a data driver 40, a timing controller 50, an image pattern calculator 60, and the like.

The liquid crystal display panel 10, the data driver 40, the timing controller 50 and the image pattern calculator 60 of the liquid crystal display shown in FIG. 13 are substantially the same as the liquid crystal display panel 10, the data driver 40, the timing controller 50 and the image pattern calculator 60 of the liquid crystal display shown in FIG. 2. The same or like elements shown in FIG. 13 have been labeled with the same reference characters as used above to describe the exemplary embodiments of liquid crystal display shown in FIG. 2, and any repetitive detailed description thereof will hereinafter be omitted or simplified.

In an exemplary embodiment, as shown in FIG. 13, the scan driver of the liquid crystal display includes a scan drive circuit 70. The scan drive circuit 70 may be disposed adjacent to one side of the pixel array PA. The one side may be a left side as shown in FIG. 13 or alternatively, the one side may be a right side. The scan drive circuit 70 may be disposed on a scan tape carrier package. The scan TCP may be connected or bonded to the liquid crystal display panel 10 by the tape automated bonding process. In an alternative exemplary embodiment, the scan drive circuit 70 may be directly provide or formed on the lower substrate by a gate in panel ("GIP") process.

The scan drive circuit 70 receives a scan timing control signal SCS from the timing controller 50. The scan drive circuit 70 supplies scan signals to scan lines G1 to Gn in response to the scan timing control signal SCS.

As described above, in such an embodiment, the scan drive circuit 70 may be driven based on one of the SA mode and the TMA mode. Hereinafter, the scan drive circuit 70 of the liquid crystal display will be described in detail with reference to FIGS. 14 to 16.

Figure 14:
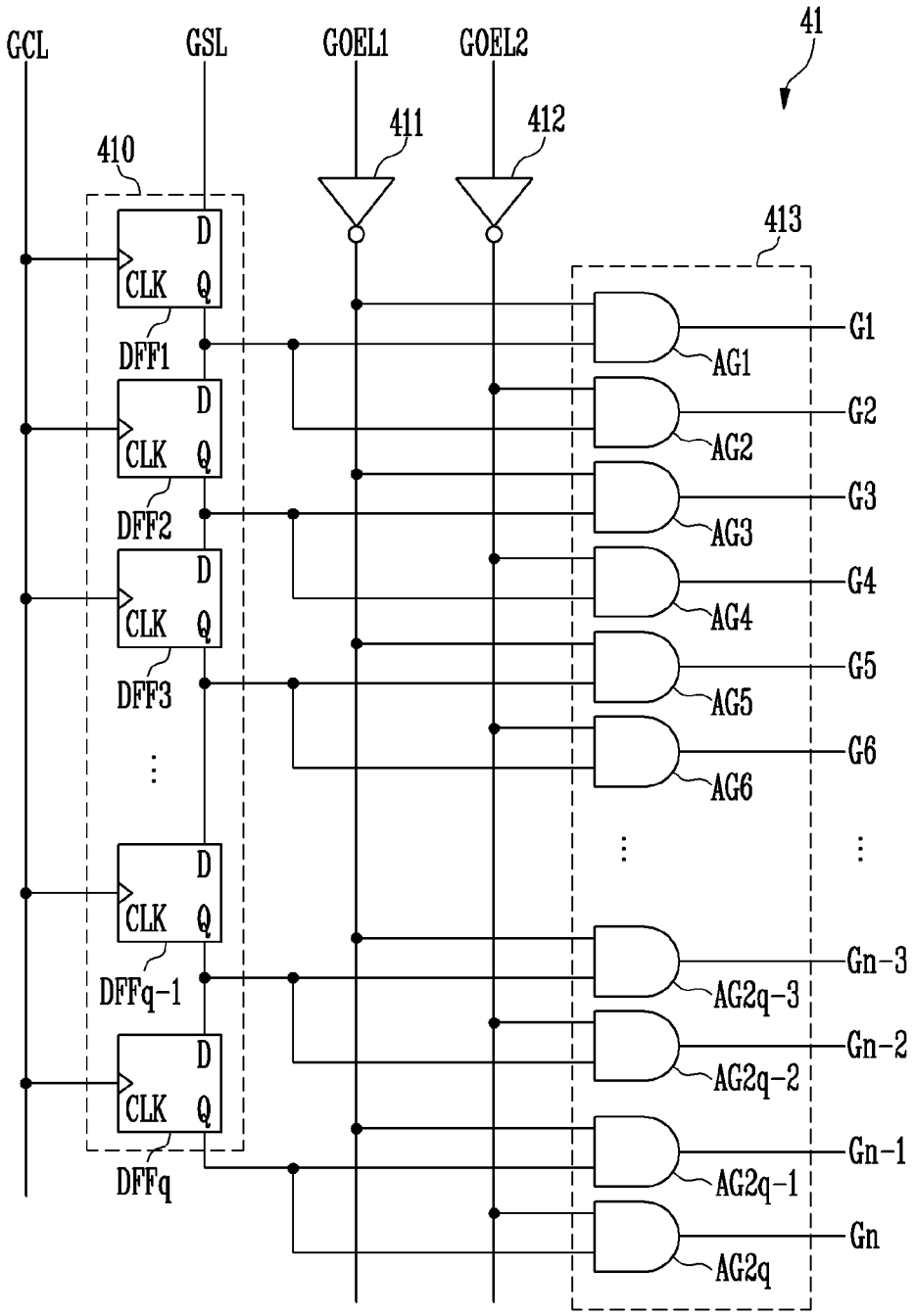
FIG. 14 is a block diagram showing an exemplary embodiment of a scan driver of FIG. 13.

FIG. 14 is a block diagram showing an exemplary embodiment of the scan driver of FIG. 13. The scan drive circuit 70 includes a shift register 41, a level shifter, an output buffer, and the like. The shift register 41 sequentially shifts a scan start signal GST according to a scan clock signal GCLK, and outputs scan signals according to first and second scan output enable signals GOE1, GOE2. The level shifter converts a swing width of each of the scan signals to a swing width suitable for driving thin film transistors of the liquid crystal display panel 10. In FIG. 14, only the shift register 41 is illustrated for convenience of the explanation.

Referring to FIG. 14, the shift register 41 includes a D flip-flop circuit 410, a first inverter 411, a second inverter 412 and AND gates 413. The D flip-flop circuit 410 has first to q-th D flip-flops DFF1 to DFFq, which are connected to each other in a cascade manner. The AND gates 413 includes first to 2q-th AND gates AG1 to AG2*q*.

An input terminal D of a D flip-flop of the D flip-flop circuit 410 is coupled to scan start signal line GSTL to which a scan start signal is supplied or an output terminal Q of a front D flip-flop. A clock terminal CLK of the D flip-flop of the D flip-flop circuit 410 is coupled to a scan clock signal line GCLK to which a scan clock signal is supplied. An output terminal Q of the D flip-flop of the D flip-flop circuit 410 is coupled to an input terminal of a rear D flip-flop. Also, an output terminal Q of the p-th D flip-flop DFFp of the D flip-flop circuit 410 is coupled to (2p−1)-th and (2p)-th AND gates AG2*p*−1, AG2*p*. In one exemplary embodiment, for example, an output terminal Q of the first flip-flop DFF1 of the D flip-flop circuit 410 is coupled to first and second AND gates AG1, AG2.

The first inverter 411 supplies an inversion signal of the first scan output enable signal GOE1 to the AND gates 413. The second inverter 412 supplies an inversion signal of the second scan output enable signal GOE2 to the AND gates 413.

The (2p−1)-th AND gate AG2*p*−1 of the AND gates 413 outputs a result of AND operation for the inversion signal of the first scan output enable signal GOE1 and an output signal of the p-th flip-flop DFFp to (2p−1)-th scan line G2*p*−1. The (2p−1)-th scan line G2*p*−1 refers to an odd scan line, and the (2p−1)-th AND gate AG2*p*−1 refers to an odd AND gate. Also, the (2p)-th AND gate AG2*p* of the AND gates 413 outputs a result of AND operation for the inversion signal of the second scan output enable signal GOE2 and an output signal of the p-th flip-flop DFFp to the (2p)-th scan line G2*p*. The (2p)-th scan line G2*p* refers to an even scan line, and the (2p)-th AND gate AG2*p* refers to an even AND gate.

The input and output signals of the scan drive circuit 70 illustrated in FIG. 14 in the SA mode may be substantially the same as the input and output signals illustrated in FIG. 5. Hereinafter, operation timings of the scan drive circuit 70 and the data driver 40 in the SA mode will be described in detail with reference to FIGS. 5 and 14.

The scan drive circuit 70 receives the scan start signal GST, the scan clock signal GCLK, and the first and second scan output enable signals GOE1, GOE2 from the timing controller 50. The D flip-flop circuit 410 of the scan drive circuit 70 sequentially outputs pulses based on the scan clock signal GCLK in response to scan start signal GST.

The scan drive circuit 70 receives the first and second scan output enable signals GOE1, GOE2. A cycle of each of the first and second scan output enable signals GOE1, GOE2 may correspond to two horizontal periods. The first scan output enable signal GOE1 has a low logic level during a (2p−1)-th horizontal period, and has a high logic level during a (2p)-th horizontal period as shown in FIG. 5. The second scan output enable signal GOE2 has a low logic level during the (2p)-th horizontal period, and has a high logic level during the (2p−1)-th horizontal period as shown in FIG. 5. As a result, the scan drive circuit 70 sequentially output the scan signals GP1 to GPn to the scan lines G1 to Gn as shown in FIG. 5.

The data driver 40 supplies the data voltages DATA, which are synchronized with the scan signals GP1 to GPn, to the data lines D1 to Dm. The data driver 40 may supply first to n-th data voltages V1 to Vn to a data line.

Meanwhile, input and output signals of the scan drive circuit 70 illustrated in FIG. 14 in the TMA mode may be substantially the same as the input and output signals illustrated in FIG. 6. Hereinafter, operation timings of the scan drive circuit 70 and the data driver 40 in the TMA mode will be described in detail with reference to FIGS. 6 and 14.

The scan drive circuit 70 receives the scan start signal GST, the scan clock signal GCLK, and the first and second scan output enable signals GOE1, GOE2 from the timing controller 50. The D flip-flop circuit 410 of the scan drive circuit 70 sequentially outputs pulses according to the scan clock signal GCLK in response to scan start signal GST.

The scan drive circuit 70 receives the first and second scan output enable signals GOE1, GOE2. A cycle of each of the first and second scan output enable signals GOE1, GOE2 may correspond to four horizontal periods. The first scan output enable signal GOE1 has a low logic level during (4r−3)-th and (4r)-th horizontal periods, and has a high logic level during (4r−2)-th and (4r−1)-th horizontal periods as shown in FIG. 6. The second scan output enable signal GOE2 has a low logic level during (4r−2)-th and (4r−1)-th horizontal periods, and has a high logic level during (4r−3)-th and (4r)-th horizontal periods as shown in FIG. 6.

As a result, in such an embodiment, the scan drive circuit 70 may output the scan signals GP1 to GPn in the order of (4r−3)-th, (4r−2)-th, (4r)-th and (4r−1)-th scan signals to the scan lines G1 to Gn as shown in FIG. 6. In one exemplary embodiment, for example, the scan drive circuit 70 may output first to fourth scan signals GP1 to GP4 in the order of first, second, fourth and third scan signals to first to fourth scan lines G1 to G4. Also, the scan drive circuit 70 may output the scan signals GP1 to GPn by a unit of four scan signals. In one exemplary embodiment, for example, the scan drive circuit 70 may output the first to fourth scan signals GP1 to GP4 in a predetermined order, and then output the fifth to eighth scan signals GP5 to GP8 in the predetermined order. In such an embodiment, the scan drive circuit 70 may output the scan signals GP1 to GPn in the predetermined order to the scan lines G1 to Gn using the first and second scan output enable signals GOE1, GOE2.

The data driver 40 supplies the data voltages DATA, which are synchronized with the scan signals GP1 to GPn, to the data lines D1 to Dm. The data driver 40 may supply first to n-th data voltages V1 to Vn in the order of outputting the scan signals GP1 to GPn to a data line. In such an embodiment, the data driver 40 may supply first to n-th data voltages V1 to Vn in the order of the (4r−3)-th, (4r−2)-th, (4r)-th and (4r−1)-th data voltages when the scan drive circuit 70 outputs the scan signals GP1 to GPn in the order of (4r−3)-th, (4r−2)-th, (4r)-th and (4r−1)-th scan signals. In one exemplary embodiment, for example, the data driver 40 may supply first to fourth data voltages V1 to V4 in the order of first, second, fourth and the third data voltages.

In an exemplary embodiment, the operation timings of the scan drive circuit 70 and the data driver 40 is controlled based on one of the SA mode and the TMA mode by controlling the first and second output enable signals GOE1, GOE2. As a result, in such an embodiment, the operation timings of the scan drive circuit 70 and the data driver 40 are controlled based on the TMA mode when the predetermined image pattern such as the horizontal stripe pattern is displayed in the liquid crystal display panel 10. Therefore, in such an embodiment, power consumption may be reduced by minimizing a swing cycle of the data voltages when the predetermined image pattern is displayed in the liquid crystal display panel 10.

In such an embodiment, the operation timings of the scan drive circuit 70 and the data driver 40 is controlled based on one of the SA mode and the TMA mode using only four signals, such as the scan start signal GST, the scan clock signal GCLK, and the first and second scan output enable signals GOE1, GOE2, such that the number of the signal lines for connecting the timing controller 50 with the scan drive circuit 70 may be effectively minimized.

Figure 15:
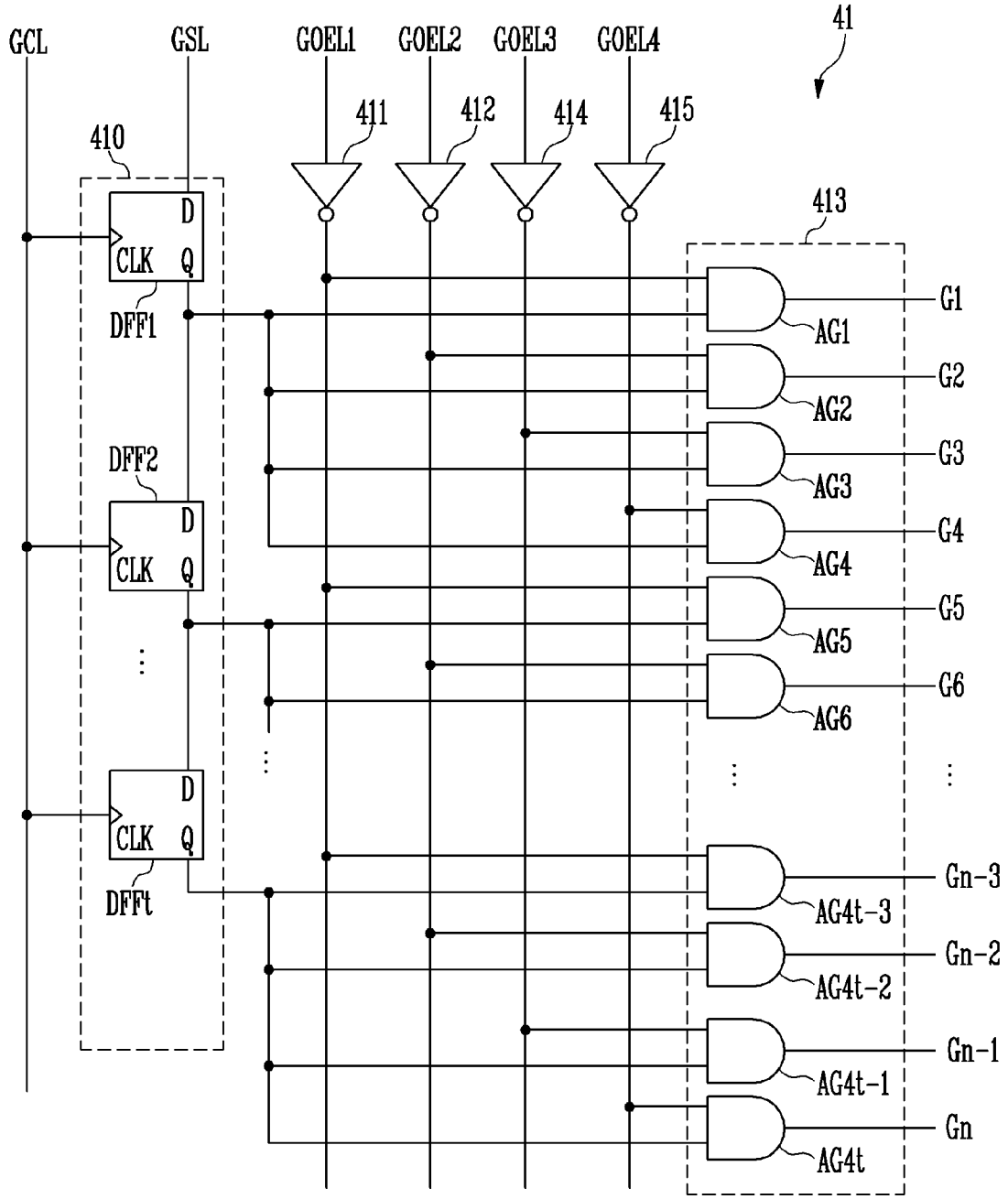
FIG. 15 is a block diagram showing an alternative exemplary embodiment of a scan driver of FIG. 13.

FIG. 15 is a block diagram showing an alternative exemplary embodiment of a scan driver of FIG. 13. The scan drive circuit 70 includes a shift register 41, a level shifter, an output buffer, and the like. The shift register 41 sequentially shifts a scan start signal GST based on a scan clock signal GCLK, and outputs scan signals based on first to fourth scan output enable signals GOE1 to GOE4. The level shifter converts a swing width of each of the scan signals to a swing width suitable for driving thin film transistors of the liquid crystal display panel 10. In FIG. 15, only the shift register 41 is illustrated for convenience of description.

Referring to FIG. 15, the shift register 41 includes a D flip-flop circuit 410, first to fourth inverters 411, 412, 414, 415 and AND gates 413. The D flip-flop circuit 410 has first to t-th D flip-flops DFF1 to DFFt, which are connected to each other in a cascade manner. The AND gates 413 includes first to 4t-th AND gates AG1 to AG4*t*.

An input terminal D of a D flip-flop of the D flip-flop circuit 410 is coupled to scan start signal line GSTL to which a scan start signal is supplied or an output terminal Q of a front D flip-flop. A clock terminal CLK of the D flip-flop of the D flip-flop circuit 410 is coupled to a scan clock signal line GCLK to which a scan clock signal is supplied. An output terminal Q of the D flip-flop of the D flip-flop circuit 410 is coupled to an input terminal of a rear D flip-flop. Also, an output terminal Q of the u-th D flip-flop DFFu of the D flip-flop circuit 410 is coupled to (4u−3)-th, (4u−2)-th, (4u−1)-th and (4u)-th AND gates AG4*u*−3, AG4*u*−2, AG4*u*−1, AG4*u*. In one exemplary embodiment, for example, an output terminal Q of the first flip-flop DFF1 of the D flip-flop circuit 410 is coupled to first to fourth AND gates AG1 to AG4.

The first inverter 411 supplies an inversion signal of the first scan output enable signal GOE1 to the AND gates 413. The second inverter 412 supplies an inversion signal of the second scan output enable signal GOE2 to the AND gates 413. The third inverter 414 supplies an inversion signal of the third scan output enable signal GOE3 to the AND gates 413. The fourth inverter 414 supplies an inversion signal of the fourth scan output enable signal GOE4 to the AND gates 413.

The (4u−3)-th AND gate AG4*u*−3 of the AND gates 413 outputs a result of AND operation for the inversion signal of the first scan output enable signal GOE1 and an output signal of the u-th flip-flop DFFu to (4u−3)-th scan line G4*u*−3. The (4u−2)-th AND gate AG4*u*−2 of the AND gates 413 outputs a result of AND operation for the inversion signal of the second scan output enable signal GOE2 and an output signal of the u-th flip-flop DFFu to the (4u−2)-th scan line G4*u*−2. The (4u−1)-th AND gate AG4*u*−1 of the AND gates 413 outputs a result of AND operation for the inversion signal of the third scan output enable signal GOE3 and an output signal of the u-th flip-flop DFFu to (4u−1)-th scan line G4*u*−1. The (4u)-th AND gate AG4*u* of the AND gates 413 outputs a result of AND operation for the inversion signal of the fourth scan output enable signal GOE4 and an output signal of the u-th flip-flop DFFu to (4u)-th scan line G4*u*.

The input and output signals of the scan drive circuit 70 illustrated in FIG. 15 in the SA mode may be substantially the same as the input and output signals illustrated in FIG. 10. Hereinafter, operation timings of the scan drive circuit 70 and the data driver 40 in the SA mode will be described in detail with reference to FIGS. 10 and 15.

The scan drive circuit 70 receives the scan start signal GST, the scan clock signal GCLK, and the first to fourth scan output enable signals GOE1 to GOE4 from the timing controller 50. The D flip-flop circuit 410 of the scan drive circuit 70 sequentially outputs pulses according to the scan clock signal GCLK in response to scan start signal GST.

The scan drive circuit 70 receives the first to fourth scan output enable signals GOE1 to GOE4. A cycle of each of the first to fourth scan output enable signals GOE1 to GOE4 may correspond to four horizontal periods. The first scan output enable signal GOE1 has a low logic level during a (4r−3)-th horizontal period, and has a high logic level during (4r−2)-th to (4r)-th horizontal periods as shown in FIG. 10. The second scan output enable signal GOE2 has a low logic level during the (4r−2)-th horizontal period, and has a high logic level during the (4r−3)-th, (4r−1)-th and (4r)-th horizontal periods as shown in FIG. 10. The third scan output enable signal GOE3 has a low logic level during a (4r−1)-th horizontal period, and has a high logic level during (4r−3)-th, (4r−2)-th and (4r)-th horizontal periods as shown in FIG. 10. The fourth scan output enable signal GOE4 has a low logic level during the (4r)-th horizontal period, and has a high logic level during the (4r−3)-th to (4r−1)-th horizontal periods as shown in FIG. 10. As a result, in such an embodiment, the scan drive circuit 70 sequentially output the scan signals GP1 to GPn to the scan lines G1 to Gn as shown in FIG. 10.

The data driver 40 supplies the data voltages DATA, which are synchronized with the scan signals GP1 to GPn, to the data lines D1 to Dm. The data driver 40 may supply first to n-th data voltages V1 to Vn to a data line.

The input and output signals of the scan drive circuit 70 illustrated in FIG. 15 in the TMA mode may be substantially the same as the input and output signals illustrated in FIG. 11. Hereinafter, operation timings of the scan drive circuit 70 and the data driver 40 in the TMA mode will be described in detail with reference to FIGS. 11 and 15.

The scan drive circuit 70 receives the scan start signal GST, the scan clock signal GCLK, and the first to fourth scan output enable signals GOE1 to GOE4 from the timing controller 50. The D flip-flop circuit 410 of the scan drive circuit 70 sequentially outputs pulses based on the scan clock signal GCLK in response to scan start signal GST.

The scan drive circuit 70 receives the first to fourth scan output enable signals GOE1 to GOE4. A cycle of each of the first to fourth scan output enable signals GOE1, GOE2 may correspond to eight horizontal periods. The first scan output enable signal GOE1 has a low logic level during (8s−7)-th and (8s)-th horizontal periods, and has a high logic level during (8s−6)-th to (8s−1)-th horizontal periods as shown in FIG. 11. The second scan output enable signal GOE2 has a low logic level during (8s−5)-th and (8s−3)-th horizontal periods, and has a high logic level during (8s−7)-th, (8s−6)-th, (8s−4)-th, (8s−2)-th to (8s)-th horizontal periods as shown in FIG. 11. The third scan output enable signal GOE3 has a low logic level during (8s−6)-th and (8s−1)-th horizontal periods, and has a high logic level during (8s−7)-th, (8s−4)-th to (8s−2)-th and (8s)-th horizontal periods as shown in FIG. 11. The fourth scan output enable signal GOE4 has a low logic level during (8s−4)-th and (8s−2)-th horizontal periods, and has a high logic level during (8s−7)-th to (8s−5)-th, (8s−3)-th, (8s−1)-th and (8s)-th horizontal periods as shown in FIG. 11.

As a result, in such an embodiment, the scan drive circuit 70 may output the scan signals GP1 to GPn by an order of (8s−7)-th, (8s−5)-th, (8s−6)-th, (8s−4)-th (8s−2)-th, (8s)-th, (8s−1)-th and (8s−3)-th scan signals to the scan lines G1 to Gn as shown in FIG. 11. In one exemplary embodiment, for example, the scan drive circuit 70 may output first to fourth scan signals GP1 to GP4 in the order of first, third, second, fourth, sixth, eighth, seventh and fifth scan signals to first to eighth scan lines G1 to G8. Also, the scan drive circuit 70 may output the scan signals GP1 to GPn by a unit of eight scan signals. In one exemplary embodiment, for example, the scan drive circuit 70 may output the first to eighth scan signals GP1 to GP8 in a predetermined order, and then output the ninth to sixteenth scan signals GP9 to GP16 in the predetermined order. That is, the scan drive circuit 70 may output the scan signals GP1 to GPn in the predetermined order to the scan lines G1 to Gn using the first to fourth scan output enable signals GOE1 to GOE4.

The data driver 40 supplies the data voltages DATA, which are synchronized with the scan signals GP1 to GPn, to the data lines D1 to Dm. The data driver 40 may supply first to n-th data voltages V1 to Vn based on the order of outputting the scan signals GP1 to GPn to a data line. In an exemplary embodiment, the data driver 40 may supply first to n-th data voltages V1 to Vn by an order of the (8s−7)-th, (8s−5)-th, (8s−6)-th, (8s−4)-th (8s−2)-th, 8s-th, (8s−1)-th and (8s−3)-th data voltages when the scan drive circuit 70 outputs the scan signals GP1 to GPn by an order of (8s−7)-th, (8s−5)-th, (8s−6)-th, (8s−4)-th (8s−2)-th, (8s)-th, (8s−1)-th and (8s−3)-th scan signals. In one exemplary embodiment, for example, the data driver 40 may supply first to eighth data voltages V1 to V8 in the order of first, third, second, fourth, sixth, eighth, seventh and fifth data voltages.

In an exemplary embodiment, the operation timings of the scan drive circuit 70 and the data driver 40 are controlled based on one of the SA mode and the TMA mode by controlling the first to fourth output enable signals GOE1 to GOE4. As a result, in such an embodiment, the operation timings of the scan drive circuit 70 and the data driver 40 may be controlled based on the TMA mode when the predetermined image pattern such as the horizontal stripe pattern is displayed in the liquid crystal display panel 10. Therefore, in such an embodiment, power consumption may be reduced by minimizing a swing cycle of the data voltages when the predetermined image pattern is displayed in the liquid crystal display panel 10.

Figure 16:
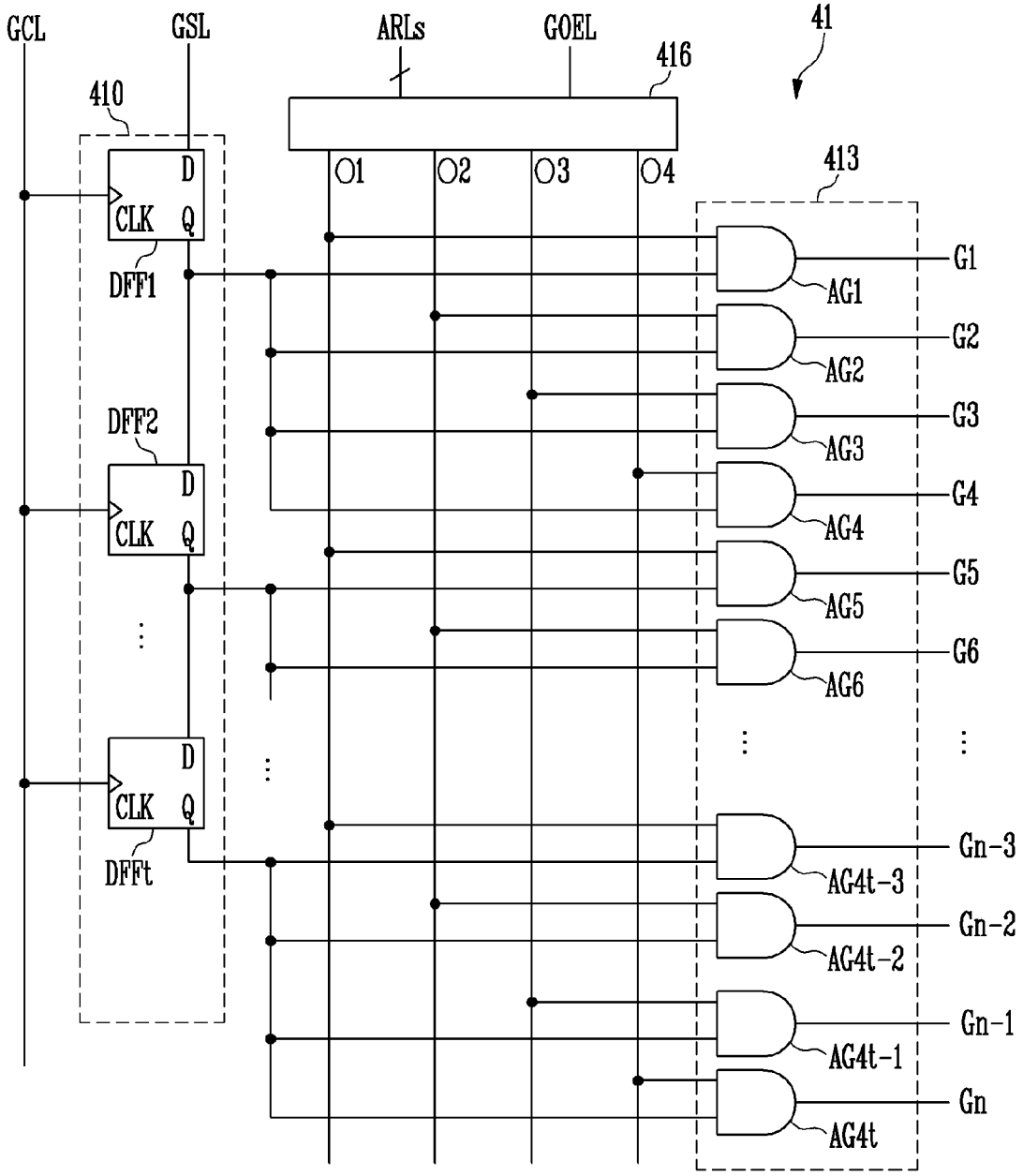
FIG. 16 is a block diagram showing another alternative exemplary embodiment of a scan driver of FIG. 13.

FIG. 16 is a block diagram showing another alternative exemplary embodiment of a scan driver of FIG. 13. In such an embodiment, the scan drive circuit 70 includes a shift register 41, a level shifter, an output buffer, and the like. The shift register 41 sequentially shifts a scan start signal GST based on a scan clock signal GCLK, and outputs scan signals based on a scan output enable signal GOE and address signals ADDR1 and ADDR2 (shown in FIG. 17). The level shifter converts a swing width of each of the scan signals to a swing width suitable for driving thin film transistors of the liquid crystal display panel 10. In FIG. 16, only the shift register 41 is illustrated for convenience of description.

Referring to FIG. 16, the shift register 41 includes a D flip-flop circuit 410, AND gates 413 and an output controller 416. The D flip-flop circuit 410 has first to t-th D flip-flops DFF1 to DFFt, which are connected to each other in a cascade manner. The AND gates 413 includes first to 4t-th AND gates AG1 to AG4*t*.

An input terminal D of a D flip-flop of the D flip-flop circuit 410 is coupled to scan start signal line GSTL to which a scan start signal is supplied or an output terminal Q of a front D flip-flop. A clock terminal CLK of the D flip-flop of the D flip-flop circuit 410 is coupled to a scan clock signal line GCLK to which a scan clock signal is supplied. An output terminal Q of the D flip-flop of the D flip-flop circuit 410 is coupled to an input terminal of a rear D flip-flop. Also, an output terminal Q of the u-th D flip-flop DFFu of the D flip-flop circuit 410 is coupled to (4u−3)-th, (4u−2)-th, (4u−1)-th and (4u)-th AND gates AG4*u*−3, AG4*u*−2, AG4*u*−1, AG4*u*. In one exemplary embodiment, for example, an output terminal Q of the first flip-flop DFF1 of the D flip-flop circuit 410 is coupled to first to fourth AND gates AG1 to AG4.

The output controller 416 receives address signals through address signal lines ARLs and the scan output enable signal GOE through a scan output enable signal line GOEL. The output controller 416 supplies the scan output enable signal GOE or an inversion signal of the scan output enable signal GOE to first to fourth output lines O1 to O4 based on the address signals ADDR and ADDR2.

In one exemplary embodiment, for example, the output controller 416 receives first and second address signals ADDR1 and ADDR2. The output controller 416 may supply the inversion signal of the scan output enable signal GOE to the first output line O1 and the scan output enable signal GOE to second to fourth output lines O2 to O4 when the first address signal ADDR1 has a low logic level and the second address signal ADDR2 has the low logic level. The output controller 416 may supply the inversion signal of the scan output enable signal GOE to the second output line O2 and the scan output enable signal GOE to the first, third and fourth output lines O1, O3, O4 when the first address signal ADDR1 has the low logic level and the second address signal ADDR2 has a high logic level. The output controller 416 may supply the inversion signal of the scan output enable signal GOE to the third output line O3 and the scan output enable signal GOE to the first, second and fourth output lines O1, O2, O4 when the first address signal ADDR1 has the high logic level and the second address signal ADDR2 has the low logic level. The output controller 416 may supply the inversion signal of the scan output enable signal GOE to the fourth output line O4 and the scan output enable signal GOE to the first to third output lines O1 to O3 when the first address signal ADDR1 has the high logic level and the second address signal ADDR2 has the high logic level.

The (4u−3)-th AND gate AG4*u*−3 of the AND gates 413 outputs a result of AND operation for an output signal of the first output line O1 and an output signal of the u-th flip-flop DFFu to (4u−3)-th scan line G4*u*−3. The (4u−2)-th AND gate AG4*u*−2 of the AND gates 413 outputs a result of AND operation for an output signal of the second output line O2 and an output signal of the u-th flip-flop DFFu to (4u−2)-th scan line G4*u*−2. The (4u−1)-th AND gate AG4*u*−1 of the AND gates 413 outputs a result of AND operation for an output signal of the third output line O3 and an output signal of the u-th flip-flop DFFu to (4u−1)-th scan line G4*u*−1. The 4u-th AND gate AG4*u* of the AND gates 413 outputs a result of AND operation for an output signal of the fourth output line O4 and an output signal of the u-th flip-flop DFFu to (4u)-th scan line G4*u*.

Figure 17:
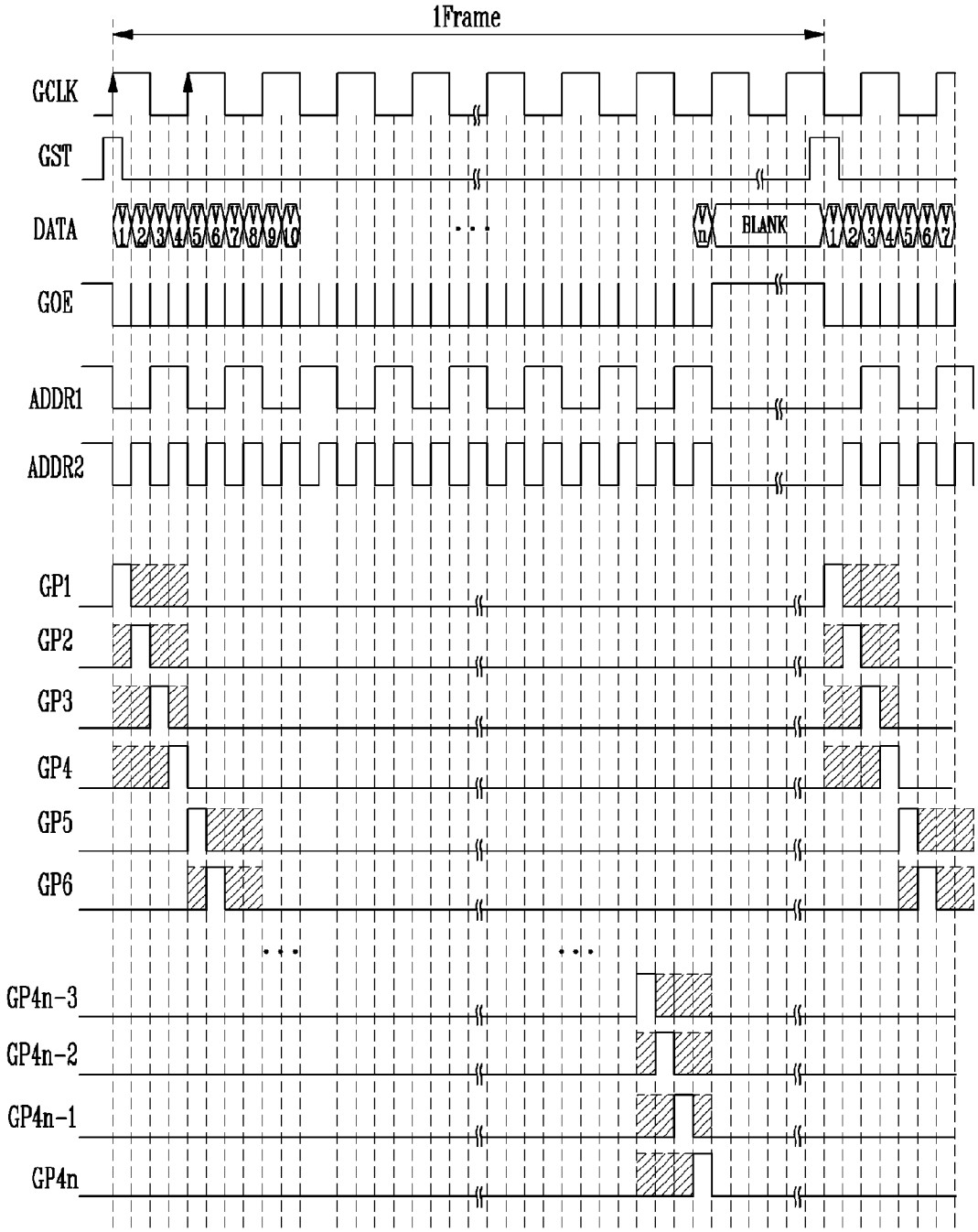
FIG. 17 is a waveform diagram showing input and output signals of the scan driver of FIG. 16 in a SA mode.

FIG. 17 is a signal timing diagram showing input and output signals of the scan driver of FIG. 16 in a SA mode. In FIG. 17, a scan clock signal GCLK, a scan start signal GST, scan output enable signal GOE, address signals ADDR1 and ADDR2 from the timing controller 50 are illustrated. Also, in FIG. 17, data voltages DATA from the data driver 40, first to sixth scan signals GP1 to GP6, and (n−3)-th to n-th scan signals GPn−3 to GPn are illustrated.

Referring to FIG. 17, a pulse of the scan start signal GST is generated at a start time of a frame period. A pulse cycle of the scan start signal GST may correspond to one frame period. A pulse cycle of the scan clock signal GCLK and a pulse cycle of a first address signal ADDR1 may correspond to four horizontal periods, and a pulse cycle of a second address signal ADDR2 may correspond to two horizontal periods, and a pulse cycle of the scan output enable signal GOE may correspond to one horizontal period in FIG. 17, but not being limited thereto.

The pulse of the scan clock signal GCLK may be generated during a vertical blank period BLANK. The pulse of the scan output enable signal GOE and the pulse of each of the first and second address signal ADDR1 and ADDR2 may not be generated during the vertical blank period BLANK.

In FIG. 17, the data voltages DATA supplied to a data line are illustrated. The data voltages DATA are supplied every one horizontal period.

Hereinafter, operation timings of the scan drive circuit 70 and the data driver 40 in the SA mode will be described in detail with reference to FIGS. 16 and 17.

The scan drive circuit 70 receives the scan start signal GST, the scan clock signal GCLK, the scan output enable signal GOE, and the first and second address signals ADDR1, ADDR2 from the timing controller 50. The D flip-flop circuits 410 of the scan drive circuit 70 sequentially output pulses based on the scan clock signal GCLK in response to scan start signal GST.

The output controller 416 supply the scan output enable signal GOE or the inversion signal of the scan output enable signal GOE based on the first and second address signals ADDR1 and ADDR2. The output controller 416 may supply the inversion signal of the scan output enable signal GOE to the first output line O1 and the scan output enable signal GOE to second to fourth output lines O2 to O4 since the first address signal ADDR1 has a low logic level and the second address signal ADDR2 has the low logic level during a (4r−3)-th horizontal period in FIG. 17. The output controller 416 may supply the inversion signal of the scan output enable signal GOE to the second output line O2 and the scan output enable signal GOE to the first, third and fourth output lines O1, O3, O4 since the first address signal ADDR1 has the low logic level and the second address signal ADDR2 has a high logic level during a (4r−2)-th horizontal period in FIG. 17. The output controller 416 may supply the inversion signal of the scan output enable signal GOE to the third output line O3 and the scan output enable signal GOE to the first, second and fourth output lines O1, O2, O4 since the first address signal ADDR1 has the high logic level and the second address signal ADDR2 has the low logic level during a (4r−1)-th horizontal period in FIG. 17. The output controller 416 may supply the inversion signal of the scan output enable signal GOE to the fourth output line O4 and the scan output enable signal GOE to the first to third output lines O1 to O3 since the first address signal ADDR1 has the high logic level and the second address signal ADDR2 has the high logic level during a (4r)-th horizontal period in FIG. 17. As a result, the scan drive circuit 70 sequentially output the scan signals GP1 to GPn to the scan lines G1 to Gn as shown in FIG. 17.

The data driver 40 supplies the data voltages DATA, which are synchronized with the scan signals GP1 to GPn, to the data lines D1 to Dm. The data driver 40 may supply first to n-th data voltages V1 to Vn to a data line.

Figure 18:
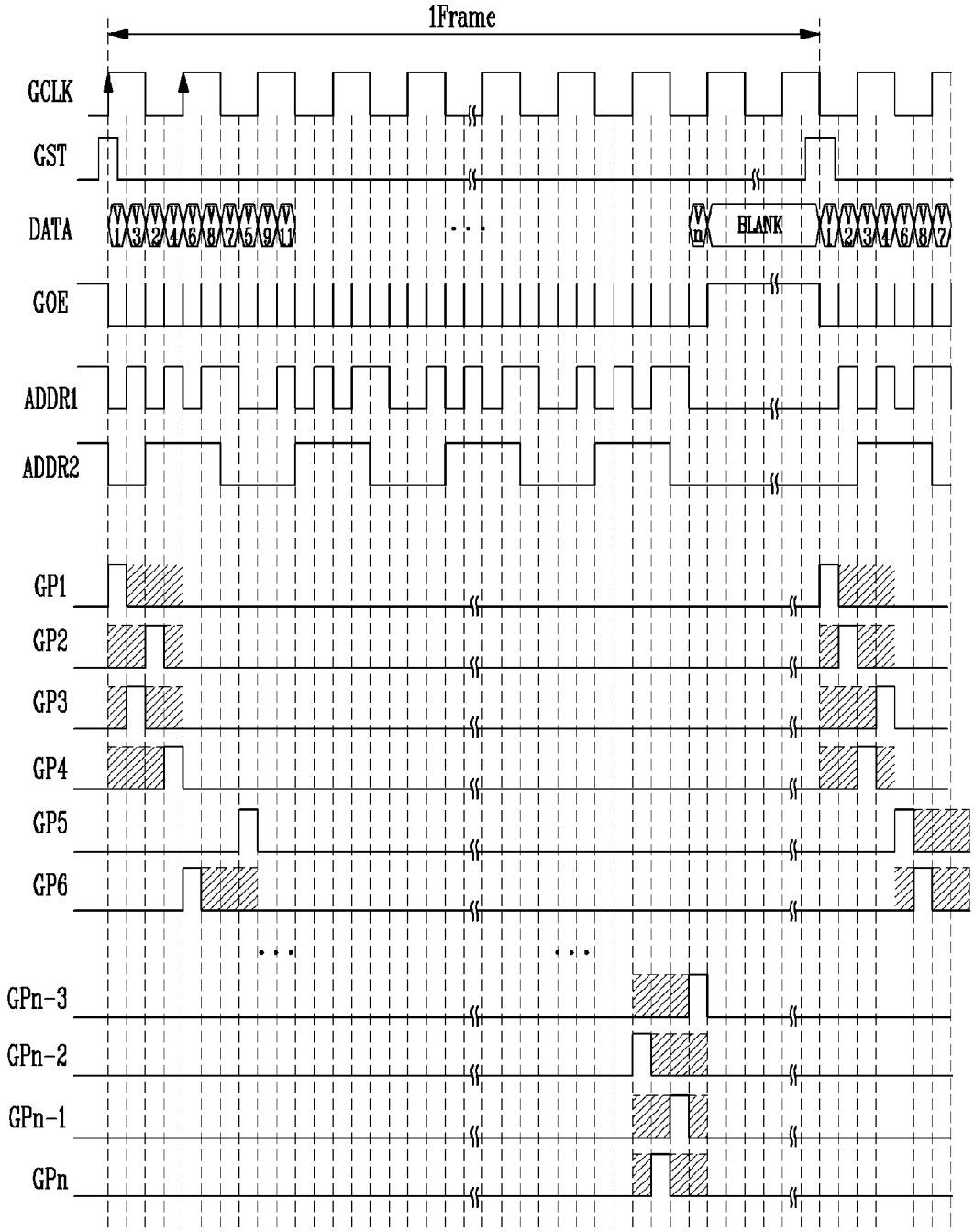
FIG. 18 is a waveform diagram showing input and output signals of the scan driver of FIG. 16 in a TMA mode.

FIG. 18 is a signal timing diagram showing input and output signals of the scan driver of FIG. 16 in a TMA mode. In FIG. 18, a scan clock signal GCLK, a scan start signal GST, scan output enable signal GOE, address signals ADDR1 and ADDR2 from the timing controller 50 are illustrated. Also, in FIG. 18, data voltages DATA from the data driver 40, first to sixth scan signals GP1 to GP6, and (n−3)-th to n-th scan signals GPn−3 to GPn are illustrated.

Referring to FIG. 18, a pulse of the scan start signal GST is generated at a start time of a frame period. A pulse cycle of the scan start signal GST may correspond to one frame period. A pulse cycle of the scan clock signal GCLK may correspond to four horizontal periods, and a pulse cycle of each of first and second address signals ADDR1 and ADDR2 may correspond to eight horizontal periods, and a pulse cycle of the scan output enable signal GOE may correspond to one horizontal period in FIG. 18, but not being limited thereto.

The pulse of the scan clock signal GCLK may be generated during a vertical blank period BLANK. The pulse of the scan output enable signal GOE and the pulse of each of the first and second address signal ADDR1 and ADDR2 may not be generated during the vertical blank period BLANK.

In FIG. 18, the data voltages DATA supplied to a data line are illustrated. The data voltages DATA are supplied every one horizontal period.

Hereinafter, operation timings of the scan drive circuit 70 and the data driver 40 in the TMA mode will be described in detail with reference to FIGS. 16 and 18.

The scan drive circuit 70 receives the scan start signal GST, the scan clock signal GCLK, the scan output enable signal GOE, and the first and second address signals ADDR1, ADDR2 from the timing controller 50. The D flip-flop circuits 410 of the scan drive circuit 70 sequentially output pulses based on the scan clock signal GCLK in response to scan start signal GST.

The output controller 416 supply the scan output enable signal GOE or the inversion signal of the scan output enable signal GOE according to the first and second address signals ADDR1 and ADDR2. The output controller 416 may supply the inversion signal of the scan output enable signal GOE to the first output line O1 and the scan output enable signal GOE to second to fourth output lines O2 to O4 since the first address signal ADDR1 has a low logic level and the second address signal ADDR2 has the low logic level during a (8s−7)-th horizontal period in FIG. 18. The output controller 416 may supply the inversion signal of the scan output enable signal GOE to the third output line O3 and the scan output enable signal GOE to the first, second and fourth output lines O1, O2, O4 since the first address signal ADDR1 has the high logic level and the second address signal ADDR2 has the low logic level during a (8s−6)-th horizontal period in FIG. 18. The output controller 416 may supply the inversion signal of the scan output enable signal GOE to the second output line O2 and the scan output enable signal GOE to the first, third and fourth output lines O1, O3, O4 since the first address signal ADDR1 has the low logic level and the second address signal ADDR2 has a high logic level during a (8s−5)-th horizontal period in FIG. 18. The output controller 416 may supply the inversion signal of the scan output enable signal GOE to the fourth output line O4 and the scan output enable signal GOE to the first to third output lines O1 to O3 since the first address signal ADDR1 has the high logic level and the second address signal ADDR2 has the high logic level during a (8s−4)-th horizontal period in FIG. 18.

In such an embodiment, the output controller 416 may supply the inversion signal of the scan output enable signal GOE to the second output line O2 and the scan output enable signal GOE to the first, third and fourth output lines O1, O3, O4 since the first address signal ADDR1 has the low logic level and the second address signal ADDR2 has a high logic level during a (8s−3)-th horizontal period in FIG. 18. The output controller 416 may supply the inversion signal of the scan output enable signal GOE to the fourth output line O4 and the scan output enable signal GOE to the first to third output lines O1 to O3 since the first address signal ADDR1 has the high logic level and the second address signal ADDR2 has the high logic level during a (8s−2)-th horizontal period in FIG. 18. The output controller 416 may supply the inversion signal of the scan output enable signal GOE to the third output line O3 and the scan output enable signal GOE to the first, second and fourth output lines O1, O2, O4 since the first address signal ADDR1 has the high logic level and the second address signal ADDR2 has the low logic level during a (8s−1)-th horizontal period in FIG. 18. The output controller 416 may supply the inversion signal of the scan output enable signal GOE to the first output line O1 and the scan output enable signal GOE to second to fourth output lines O2 to O4 since the first address signal ADDR1 has a low logic level and the second address signal ADDR2 has the low logic level during a (8s)-th horizontal period in FIG. 18.

As a result, in such an embodiment, the scan drive circuit 70 may output the scan signals GP1 to GPn in the order of (8s−7)-th, (8s−5)-th, (8s−6)-th, (8s−4)-th (8s−2)-th, (8s)-th, (8s−1)-th and (8s−3)-th scan signals to the scan lines G1 to Gn as shown in FIG. 18. In one exemplary embodiment, for example, the scan drive circuit 70 may output first to fourth scan signals GP1 to GP4 in the order of first, third, second, fourth, sixth, eighth, seventh and fifth scan signals to first to eighth scan lines G1 to G8. Also, the scan drive circuit 70 may output the scan signals GP1 to GPn by a unit of eight scan signals. In one exemplary embodiment, for example, the scan drive circuit 70 may output the first to eighth scan signals GP1 to GP8 in a predetermined order, and then output the ninth to sixteenth scan signals GP9 to GP16 in the predetermined order. In such an embodiment, the scan drive circuit 70 may output the scan signals GP1 to GPn in the predetermined order to the scan lines G1 to Gn using the first and second address signals ADDR1 and ADDR2.

The data driver 40 supplies the data voltages DATA, which are synchronized with the scan signals GP1 to GPn, to the data lines D1 to Dm. The data driver 40 may supply first to n-th data voltages V1 to Vn in the order of outputting the scan signals GP1 to GPn to a data line. In such an embodiment, the data driver 40 may supply first to n-th data voltages V1 to Vn in the order of the (8s−7)-th, (8s−5)-th, (8s−6)-th, (8s−4)-th (8s−2)-th, 8s-th, (8s−1)-th and (8s−3)-th data voltages when the scan drive circuit 70 outputs the scan signals GP1 to GPn in the order of (8s−7)-th, (8s−5)-th, (8s−6)-th, (8s−4)-th (8s−2)-th, (8s)-th, (8s−1)-th and (8s−3)-th scan signals. In one exemplary embodiment, for example, the data driver 40 may supply first to eighth data voltages V1 to V8 in the order of first, third, second, fourth, sixth, eighth, seventh and fifth data voltages.

In such an embodiment, the operation timings of the scan drive circuit 70 and the data driver 40 are controlled based on one of the SA mode and the TMA mode by controlling the first and second address signals ADDR1 and ADDR2. As a result, in such an embodiment, the operation timings of the scan drive circuit 70 and the data driver 40 may be controlled based on the TMA mode when the predetermined image pattern such as the horizontal stripe pattern is displayed in the liquid crystal display panel 10. Therefore, in such an embodiment, power consumption may be reduced by minimizing a swing cycle of the data voltages when the predetermined image pattern is displayed in the liquid crystal display panel 10.

In such an embodiment, the operation timings of the scan drive circuit 70 and the data driver 40 may be controlled based on one of the SA mode and the TMA mode using only five signals, such as the scan start signal GST, the scan clock signal GCLK, the first and second address signals ADDR1 and ADDR2, and the scan output enable signal GOE. Therefore, in such an embodiment, the number of the signal lines for connecting the timing controller 50 with the scan drive circuit 70 may be substantially minimized.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention as set forth in the following claims.

What is claimed is:

1. A liquid crystal display, comprising:

a display panel comprising data lines, scan lines, and a plurality of pixels connected to the data lines and the scan lines;

a scan driver configured to supply scan signals to the scan lines;

a data driver configured to supply data voltages to the data lines; and a timing controller configured to control operation timings of the scan driver and the data driver, wherein the timing controller is configured to output a plurality of scan output enable signals to the scan driver, wherein the scan driver is configured to supply odd scan signals to odd scan lines based on a first scan output enable signal of the scan output enable signals, to supply even scan signals to even scan lines based on a second scan output enable signal of the scan output enable signals, and to supply the scan signals to the scan lines in a non-sequential order in a transition minimization addressing mode.

2. The liquid crystal display of claim 1, wherein a phase of the first scan output enable signal is different from a phase of the second scan output enable signal, or the second scan output enable signal is a signal delayed from the first scan output enable signal.

3. The liquid crystal display of claim 1, wherein the scan driver is configured to sequentially supply the scan signals to the scan lines in a sequential addressing mode.

4. The liquid crystal display of claim 3, wherein the timing controller is configured to output a scan start signal and a scan clock signal to the scan driver.

5. The liquid crystal display of claim 4, wherein phases of the first and second scan output enable signals in the sequential addressing mode is different from phases of the first and second scan output enable signals in the transition minimization addressing mode.

6. The liquid crystal display of claim 5, wherein the scan driver comprises:

a D flip-flop circuit configured to sequentially output pulse signals based on the scan clock signal in response to the scan start signal;

odd AND gates coupled to the odd scan lines, wherein the odd AND gates are configured to output a result of AND operation for an inversion signal of the first scan output enable signal and the pulse signals from the D flip-flop circuit, and; and even AND gates coupled to the even scan lines, wherein the even AND gates are configured to output a result of AND operation for an inversion signal of the second scan output enable signal and the pulse signals from the D flip-flop circuit.

7. The liquid crystal display of claim 5, wherein the scan driver comprises:

a first scan drive circuit configured to receive the scan start signal, the scan clock signal and the first scan output enable signal; and a second scan drive circuit configured to receive the scan start signal, the scan clock signal and the second scan output enable signal.

8. The liquid crystal display of claim 7, wherein the first scan drive circuit comprises:

a first D flip-flop circuit configured to sequentially output pulse signals based on the scan clock signal in response to the scan start signal; and a first AND gate group coupled to the odd scan lines, wherein the first AND gate group is configured to output a result of AND operation for an inversion signal of the first scan output enable signal and the pulse signals from the first D flip-flop circuit.

9. The liquid crystal display of claim 8, wherein the second scan drive circuit comprises:

a second D flip-flop circuit configured to sequentially output pulse signals according to the scan clock signal in response to the scan start signal; and a second AND gate group coupled to the even scan lines, wherein the second AND gate group is configured to output a result of AND operation for an inversion signal of the second scan output enable signal and the pulse signals from the second D flip-flop circuit.

10. The liquid crystal display of claim 4, wherein the scan driver is configured to supply scan signals to (4u-3)-th scan lines based on the first scan output enable signal, to supply scan signals to (4u-2)-th scan lines based on the second scan output enable signal, to supply scan signals to (4u-1)-th scan lines based on a third scan output enable signal of the scan output enable signals, and to supply scan signals to (4u)-th scan lines based on a fourth scan output signal of the scan output enable signals, wherein u is a natural number.

11. The liquid crystal display of claim 10, wherein phases of the first to fourth scan output enable signals are different from each other, or the first to fourth scan output enable signals are signals sequentially delayed from one another.

12. The liquid crystal display of claim 10, wherein phases of the first to fourth scan output enable signals in the sequential addressing mode are different from phases of the first to fourth scan output enable signals in the transition minimization addressing mode.

13. The liquid crystal display of claim 12, wherein the scan driver comprises:

a D flip-flop circuit configured to sequentially output pulse signals based on the scan clock signal in response to the scan start signal;

(4u-3)-th AND gates coupled to the (4u-3)-th scan lines, wherein the (4u-3)-th AND gates are configured to output a result of AND operation for an inversion signal of the first scan output enable signal and the pulse signals from the D flip-flop circuit;

(4u-2)-th AND gates coupled to the (4u-2)-th scan lines, wherein the (4u-2)-th AND gates are configured to output a result of AND operation for an inversion signal of the second scan output enable signal and the pulse signals from the D flip-flop circuit;

(4u-1)-th AND gates coupled to the (4u-1)-th scan lines, wherein the (4u-1)-th AND gates are configured to output a result of AND operation for an inversion signal of the third scan output enable signal and the pulse signals from the D flip-flop circuit; and (4u)-th AND gates coupled to the (4u-2)-th scan lines, wherein the (4u-2)-th AND gates are configured to output a result of AND operation for an inversion signal of the fourth scan output enable signal and the pulse signals from the D flip-flop circuit.

14. The liquid crystal display of claim 12, wherein the scan driver comprises:

a first scan drive circuit configured to receive the scan start signal, the scan clock signal, and the first and third scan output enable signals; and a second scan drive circuit configured to receive the scan start signal, the scan clock signal, and the second and fourth scan output enable signal.

15. The liquid crystal display of claim 14, wherein the first scan drive circuit comprises:

a first D flip-flop circuit configured to sequentially output pulse signals according to the scan clock signal in response to the scan start signal; and a first AND gate group comprising:

odd AND gates coupled to the (4u-3)-th scan lines, wherein the odd AND gates of the first AND gate group are configured to output a result of AND operation for an inversion signal of the first scan output enable signal and the pulse signals from the first D flip-flop circuit; and even AND gates coupled to the (4u-1)-th scan lines, wherein the even AND gates of the first AND gate group are configured to output a result of AND operation for an inversion signal of the third scan output enable signal and the pulse signals from the first D flip-flop circuit.

16. The liquid crystal display of claim 15, wherein the second scan drive circuit comprises:

a second D flip-flop circuit configured to sequentially output pulse signals according to the scan clock signal in response to the scan start signal; and a second AND gate group comprising:

odd AND gates coupled to the (4u-2)-th scan lines, wherein the odd AND gates of the second AND gate group are configured to output a result of AND operation for an inversion signal of the second scan output enable signal and the pulse signals from the second D flip-flop circuit; and even AND gates coupled to the (4u)-th scan lines, wherein the even AND gates of the second AND gate group are configured to output a result of AND operation for an inversion signal of the fourth scan output enable signal and the pulse signals from the second D flip-flop circuit.

17. A method for driving a liquid crystal display, the method comprising:

outputting a plurality of scan output enable signals from a timing controller of the liquid crystal display to a scan driver of the liquid crystal display, wherein the timing controller controls the scan driver and a data driver of the liquid crystal display;

supplying scan signals from the scan driver to scan lines of a display panel of the liquid crystal display; and supplying data voltages from the data driver to data lines of the display panel of the liquid crystal display, wherein the supplying the scan signals from the scan driver to the scan lines comprises:

supplying the scan signals from the scan driver to odd scan lines based on a first scan output enable signal of the scan output enable signals;

supplying the scan signals from the scan driver to even scan lines based on a second scan output enable signal of the scan output enable signals; and supplying the scan signals from the scan driver to the scan lines in a non-sequential order in a transition minimization addressing mode.

18. A liquid crystal display, comprising:

a display panel comprising data lines, scan lines, and a plurality of pixels connected to the data lines and the scan lines;

a scan driver configured to supply scan signals to the scan lines;

a data driver configured to supply data voltages to the data lines; and a timing controller configured to control operation timings of the scan driver and the data driver, wherein the timing controller is configured to output a scan output enable signal and a plurality of address signals, wherein the scan driver is configured to output the scan signals to the scan lines based on the scan output enable signal and the address signals, and to supply the scan signals to the scan lines in a non-sequential order in a transition minimization addressing mode.

19. The liquid crystal display of claim 18, wherein the phases of the address signals are different from each other, or the address signals are signals sequentially delayed from each other.

20. A method for driving a liquid crystal display, the method comprising:

outputting a scan output enable signal and a plurality of address signals from a timing controller of the liquid crystal display to a scan driver of the liquid crystal display, wherein the timing controller controls the scan driver and a data driver of the liquid crystal display;

supplying scan signals from the scan driver to scan lines of a display panel of the liquid crystal display; and supplying data voltages from the data driver to data lines of the display panel of the liquid crystal display, wherein the supplying the scan signals from the scan driver to the scan lines comprises supplying the scan signals from the scan driver to the scan lines based on the scan output enable signal and the address signals, and supplying the scan signals from the scan driver to the scan lines in a non-sequential order in a transition minimization addressing mode.

* * * * *